US007431273B2

(12) United States Patent
Kamiya et al.

(10) Patent No.: US 7,431,273 B2
(45) Date of Patent: Oct. 7, 2008

(54) SPINE FOLDED PORTION FLATTENING APPARATUS, SHEET TREATING APPARATUS AND IMAGE FORMING APPARATUS

(75) Inventors: Daisaku Kamiya, Abiko (JP); Yusuke Obuchi, Abiko (JP); Hitoshi Fujimoto, Abiko (JP); Kiyoshi Watanabe, Kashiwa (JP); Tomokazu Nakamura, Matsudo (JP); Kenichi Hayashi, Abiko (JP); Toshimasa Suzuki, Kashiwa (JP); Hideki Kushida, Moriya (JP); Atsuteru Oikawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 236 days.

(21) Appl. No.: 11/039,786

(22) Filed: Jan. 24, 2005

(65) Prior Publication Data

US 2005/0179190 A1 Aug. 18, 2005

(30) Foreign Application Priority Data

Jan. 27, 2004 (JP) ..... 2004-019058
Jan. 17, 2005 (JP) ..... 2005-009027

(51) Int. Cl.
*B65H 37/04* (2006.01)

(52) U.S. Cl. ..... 270/37; 270/32; 270/45; 270/58.07; 270/58.08

(58) Field of Classification Search ..... 270/32, 270/37, 45, 58.07, 58.08; 399/407, 408, 399/410; 493/416; 412/1, 18, 22
See application file for complete search history.

(56) References Cited

U.S. PATENT DOCUMENTS 2,088,904 A * 8/1937 Grammer ..... 281/15.1
5,592,280 A 1/1997 Ishizuka et al. ..... 399/410
5,897,250 A 4/1999 Hirai et al. ..... 399/404
5,911,414 A 6/1999 Kato et al. ..... 270/58.07
5,961,268 A * 10/1999 Jager ..... 412/1

(Continued)

FOREIGN PATENT DOCUMENTS

EP 553870 A1 * 8/1993

(Continued)

OTHER PUBLICATIONS

Official Letter/Search Report issued on Nov. 23, 2007, by the Chinese Patent Office, in Chinese Patent Application No. 2005100058126.

*Primary Examiner*—Gene O. Crawford
*Assistant Examiner*—Leslie Nicholson, III
(74) *Attorney, Agent, or Firm*—Fitzpatrick, Cella, Harper & Scinto

(57) ABSTRACT

A sheet bundle spine folded portion flattening apparatus is provided with a conveying portion which conveys the folded sheet bundle with the spine folded portion of the folded sheet bundle at a head, a sheet bundle moving device for moving it in a direction along the spine folded portion of the sheet bundle, and a pressing device for pressing the spine folded portion of the sheet bundle being moved by the sheet bundle moving device, and is adapted to press and flatten the spine folded portion of the sheet bundle being moved by the sheet bundle moving device, by the pressing device and therefore, can flatten the spine folded portion almost without stopping the movement of the sheet bundle, as compared with the conventional art, and the sheet bundle treating efficiency is enhanced.

18 Claims, 16 Drawing Sheets

U.S. PATENT DOCUMENTS

| | | | | |
|---|---|---|---|---|
| 5,999,760 | A | 12/1999 | Suzuki et al. | 399/45 |
| 6,241,234 | B1 | 6/2001 | Saitoh et al. | 270/58.12 |
| 6,264,194 | B1 | 7/2001 | Hayashi et al. | 271/220 |
| 6,290,220 | B1 | 9/2001 | Takehara et al. | 270/58.12 |
| 6,647,243 | B2 | 11/2003 | Sato et al. | 399/407 |
| 6,671,491 | B1 | 12/2003 | Yamanaka et al. | 399/407 |
| 6,687,484 | B2 | 2/2004 | Oikawa | 399/406 |
| 6,692,208 | B1 * | 2/2004 | Watkiss et al. | 412/1 |
| 6,817,605 | B1 * | 11/2004 | Bohn | 270/37 |
| 6,826,374 | B2 * | 11/2004 | Kato et al. | 399/16 |
| 6,845,228 | B2 | 1/2005 | Suzuki et al. | 399/407 |
| 6,871,042 | B2 | 3/2005 | Nemura et al. | 399/389 |
| 6,904,261 | B2 | 6/2005 | Fujii et al. | 399/382 |
| 6,908,078 | B2 | 6/2005 | Suzuki et al. | 270/15 |
| 7,147,598 | B2 * | 12/2006 | Fujimoto et al. | 493/405 |
| 2003/0214092 | A1 * | 11/2003 | Horii et al. | 270/52.18 |
| 2004/0096254 | A1 | 5/2004 | Sato et al. | 399/405 |
| 2004/0108642 | A1 * | 6/2004 | Stolz et al. | 270/52.18 |
| 2004/0173960 | A1 | 9/2004 | Oikawa et al. | 271/208 |
| 2005/0008460 | A1 * | 1/2005 | Watkiss | 412/9 |
| 2005/0062208 | A1 * | 3/2005 | Wakabayashi et al. | 270/32 |
| 2005/0147487 | A1 * | 7/2005 | Wakabayashi et al. | 412/9 |
| 2005/0189688 | A1 * | 9/2005 | Suzuki et al. | 270/32 |
| 2005/0189689 | A1 * | 9/2005 | Kushida et al. | 270/37 |
| 2007/0120310 | A1 * | 5/2007 | Awano | 270/45 |

FOREIGN PATENT DOCUMENTS

| | | |
|---|---|---|
| EP | 1 138 521 A2 | 10/2001 |
| JP | 8-26593 | 1/1996 |
| JP | 2001-260564 | 9/2001 |

* cited by examiner

SPINE FOLDED PORTION FLATTENING APPARATUS, SHEET TREATING APPARATUS AND IMAGE FORMING APPARATUS

BACKGROUND OF THE INVENTION

1. Field of the Invention

The invention relates to a spine folded portion flattening apparatus for flattening the curved spine folded portion of a folded sheet bundle, and particularly flattening the spine folded portion while moving the sheet bundle, a sheet treating apparatus and an image forming apparatus provided with the same.

2. Related Background Art

Heretofore, a predetermined number of sheets, e.g. about 20 or fewer sheets have been stacked one upon another and have been folded into the form of a pamphlet by a suture/folding machine. As the sheet bundle folded by such a suture/folding machine, there is a simply folded sheet bundle, a saddle-stitched and folded sheet bundle, a sheet bundle not bound by yarn or staple but bound by an adhesive (perfect binding) and folded, or the like.

However, any of these sheet bundles has more or less elastic force and therefore, after it has been folded, the periphery of a spine folded portion (a top of the folded portion or a spine) bulges out into a U-shape, and the open side or the so-called fore edge of the folded sheet bundle has tended to open. Such sheet bundles, when piled, assume an unstable state, and has been liable to get out of shape and difficult to keep storing in a piled state or transport.

Against such a problem, there is a spine folded portion flattening apparatus for flattening the spine folded portion of a folded sheet bundle so that the folded sheet bundle can be placed flatly (see Japanese Patent Application Laid-Open No. 2001-260564).

The conventional spine folded portion flattening apparatus is shown in FIGS. 13, 14, 15A, 15B and 15C of the accompanying drawings. The spine folded portion flattening apparatus 101 first receives, by a vertically movable stop plate 105, a pamphlet-shaped twice-folded saddle-stitched sheet bundle S discharged in the direction indicated by the arrow B from a pair of folding rollers 107 with the spine folded portion (spine) Sb thereof as a leading edge and stops it (FIG. 15A). Thereafter, the spine folded portion flattening apparatus 101 grips the sheet bundle by grip members 102 and 103, and elevates the stop plate 105 to a waiting position (FIG. 15B). At this time, the spine folded portion Sb protrudes from the grip members 102 and 103. The stop plate 105 separates from the spine folded portion Sb. Then, the spine folded portion flattening apparatus 101 urges a pressure contact roller 104 against the spine folded portion Sb and moves it in the direction indicated by the arrow A (see FIG. 13) along the spine folded portion Sb. The spine folded portion Sb so far curved is pressed by the pressure contact roller 104 and becomes flat. Lastly, the spine folded portion flattening apparatus 101 discharges the flattened sheet bundle S onto a sheet discharging tray 108 in the direction indicated by the arrow B by a pair of discharge belt 106 and stacks it thereon (FIG. 15C). As described above, the conventional spine folded portion flattening apparatus 101 has stopped the sheet bundle and flattened the spine folded portion of the sheet bundle by the pressure contact roller 104.

Also, the conventional spine folded portion flattening apparatus 101, as shown in FIG. 16 of the accompanying drawings, has sometimes been incorporated in a sheet treating apparatus 120. The sheet treating apparatus 120 is connected to the apparatus main body 122 of an image forming apparatus 121, and cooperates with the apparatus main body 122 to constitute the image forming apparatus 121. The image forming apparatus 121 is adapted to form an image on a sheet.

The sheet treating apparatus 120 is provided with a sheet folding apparatus 109 for making sheets into a bundle shape and folding the bundle, a stapler 170 for binding the bundle-shaped sheets, a fixed sheet tray 123 and a stack tray 114 serving as vertically movable stacking means. The sheet tray 123 is adapted to stack thereon sheets discharged from the apparatus main body 122 without being subjected to any treatment. The stack tray 114 is adapted to stack thereon sheet bundles bound into a bundle shape by the stapler 170. The stack tray 114 is adapted to be moved down in conformity with the thickness of the whole of the stacked sheet bundles.

The conventional spine folded portion flattening apparatus 101 incorporated in the sheet treating apparatus 120 of the image forming apparatus 121 has been adapted to discharge a sheet bundle having had its spine folded portion flattened in a direction (the direction indicated by the arrow B in FIGS. 13 and 15C) in which it has been fed into the spine folded portion flattening apparatus 101. A sheet discharge tray portion 108 for receiving the discharged sheet bundle has been disposed beneath the stack tray 114.

The conventional spine folded portion flattening apparatus 101, however, has stopped the sheet bundle S and flattened the spine folded portion Sb of the sheet bundle S by the pressure contact roller 104 and therefore, had to stop the conveyance of the sheet bundle S as long as the pressure contact roller 104 was moved along the longitudinal direction of the spine folded portion Sb. Therefore, the conventional spine folded portion flattening apparatus 101 has been poor in the efficiency of the spine folded portion flattening process correspondingly to the time for which the conveyance of the sheet bundle S is stopped.

Also, the conventional sheet treating apparatus is provided with the spine folded portion flattening apparatus poor in the process efficiency as described above and therefore, under the influence of the process efficiency of the spine folded portion flattening apparatus, it has been poor in the sheet treating efficiency as the entire sheet treating apparatus.

Further, the conventional image forming apparatus is provided with the spine folded portion flattening apparatus which is poor in the process efficiency of flattening the spine folded portion and therefore, under the influence of the process efficiency of the spine folded portion flattening apparatus, it has been poor in the image forming efficiency as the entire image forming apparatus.

SUMMARY OF THE INVENTION

It is an object of the present invention to provide a spine folded portion flattening apparatus enhanced in the flattening process efficiency of moving a sheet bundle and flattening the spine folded portion thereof.

It is an object of the present invention to provide a sheet treating apparatus provided with a spine folded portion flattening apparatus enhanced in the process efficiency of flattening the spine folded portion of a sheet bundle, and enhanced in sheet treating efficiency.

It is an object of the present invention to provide an image forming apparatus provided with a spine folded portion flattening apparatus enhanced in the process efficiency of flattening the spine folded portion of a sheet bundle, and enhanced in the efficiency of forming an image on a sheet.

In order to achieve the above object, the spine folded portion flattening apparatus of the present invention is provided with a conveying portion (conveying means) which conveys the folded sheet bundle with the spine folded portion of the folded sheet bundle at a head; a sheet bundle moving device (moving means) which moves it in a direction along the spine folded portion of the sheet bundle, and a pressing portion (pressing means) which presses the spine folded portion of the sheet bundle being moved by the sheet bundle moving device.

In order to achieve the above object, the sheet treating apparatus of the present invention is provided with a folding device (folding means) which makes sheets into a bundle shape and folding the sheet bundle, and a spine folded portion flattening apparatus for flattening the spine folded portion of the sheet bundle folded by the folding device, and the spine folded portion flattening apparatus is the above-described spine folded portion flattening apparatus.

In order to achieve the above object, the image forming apparatus of the present invention is provided with an image forming portion (image forming means) which forms images on sheets, and a sheet treating apparatus for making the sheets having the images formed thereon by the image forming portion into a bundle shape, and folding the sheet bundle, and thereafter flattening the spine folded portion of the sheet bundle, and the sheet treating apparatus is the above-described sheet treating apparatus.

The spine folded portion flattening apparatus of the present invention is adapted to press and flatten the spine folded portion of a sheet bundle by the pressing portion while moving the sheet bundle by the sheet bundle moving device and therefore, can flatten the spine folded portion without stopping the sheet bundle, thus enhancing the spine folded portion flattening process efficiency.

The sheet treating apparatus of the present invention is provided with the spine folded portion flattening apparatus enhanced in the spine folded portion flattening process efficiency and therefore, can enhance the sheet treating efficiency of the entire sheet treating apparatus.

The image forming apparatus of the present invention is provided with the spine folded portion flattening apparatus enhanced in the spine folded portion flattening process efficiency and therefore, can enhance the image forming efficiency of the entire image forming apparatus.

BRIEF DESCRIPTION OF THE DRAWINGS

FIG. 3A shows a state in which the pair of grippers of a gripping apparatus are closed, and FIG. 3B shows a state in which the pair of grippers of the gripping apparatus are opened.

FIG. 4A shows a state in which a sheet bundle has been received, and FIG. 4B shows a state in which the gripping apparatus has conveyed the sheet bundle to a sheet discharging tray portion.

FIG. 6A shows a state in which the sheet bundle has been received, FIG. 6B shows a state in which the pair of grippers have gripped the sheet bundle, FIG. 6C shows a state in which the shaping roller is in pressure contact with the sheet bundle, and FIG. 6D shows a state in which the sheet bundle has been discharged to the sheet discharging tray portion.

FIG. 15A shows a state in which a sheet bundle has been stopped by a stop plate, FIG. 15B shows a state in which a shaping roller is in pressure contact with the spine folded portion of the sheet bundle, and FIG. 15C shows a state in which the sheet bundle has been discharged.

DESCRIPTION OF THE PREFERRED EMBODIMENTS

A spine folded portion flattening apparatus according to an embodiment of the present invention, a sheet treating apparatus provided with this spine folded portion flattening apparatus, and a copying machine which is an example of an image forming apparatus will hereinafter be described with reference to the drawings.

(Copying Machine)

Description of the Construction of the Copying Machine

Figure 1:
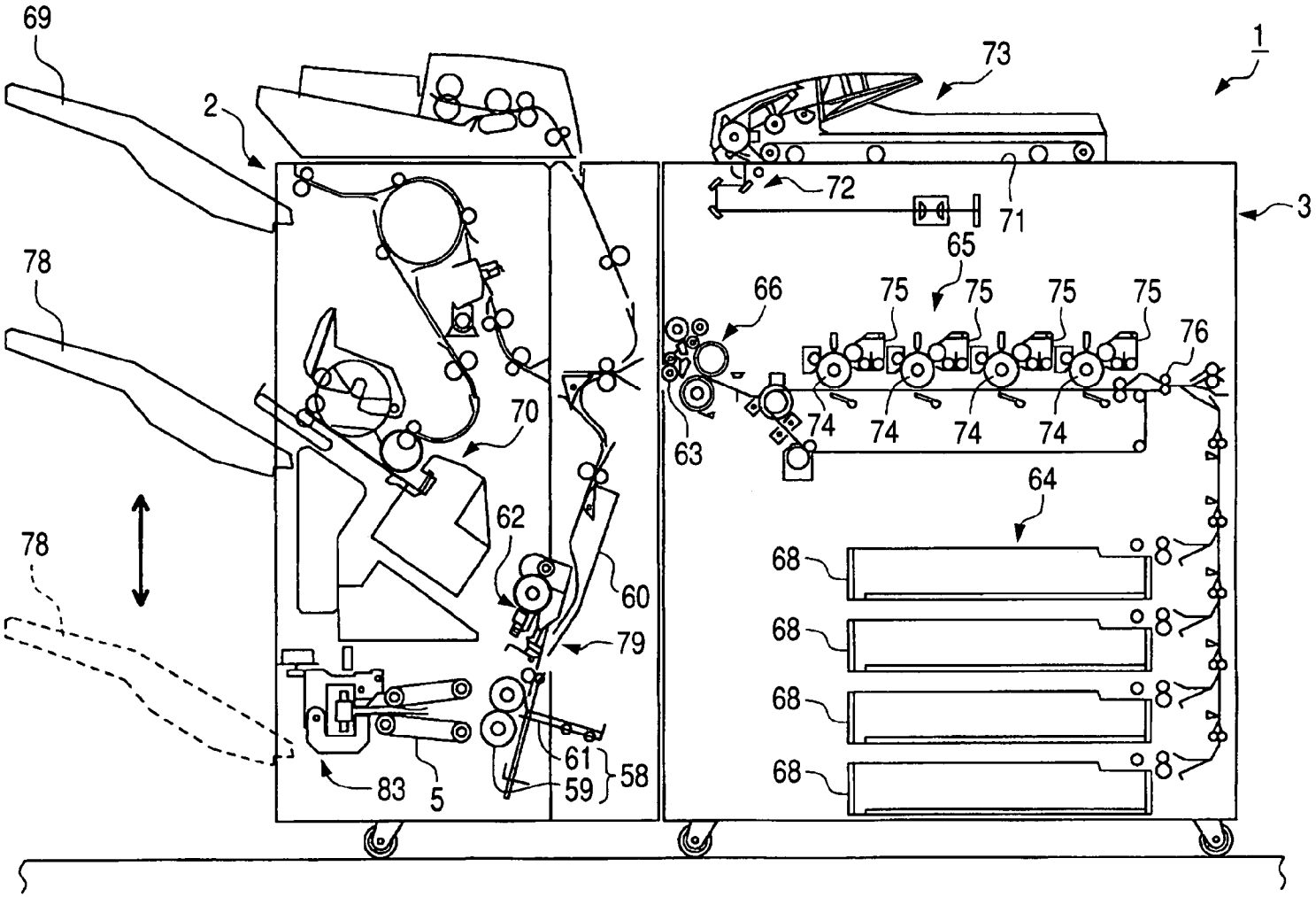
FIG. 1 is a front cross-sectional view of a copying machine which is an example of an image forming apparatus provided with a sheet treating apparatus having a spine folded portion flattening apparatus according to the present invention.

Reference is first had to FIG. 1 to describe the copying machine which is an example of the image forming apparatus provided with the sheet treating apparatus having the spine folded portion flattening apparatus according to the present invention. The copying machine 1 is a full-color copying machine and is provided with an original plate 71 as an original supporting stand, a light source and lens system 72, a sheet supplying portion 64, a pair of registration rollers 76, an image forming portion 65 as image forming means, an automatic original feeding apparatus 73 for automatically feeding an original onto the original plate 71, and a sheet treating apparatus 2 for treating a sheet having an image formed thereon which is discharged from the apparatus main body 3 of the copying machine 1.

The sheet supplying portion 64 has a plurality of cassettes 68 containing recording sheets therein and detachably mounted on the apparatus main body 3. The image forming portion 65 is provided with cylindrical photosensitive drums 74 and developing devices 75 for respective colors, i.e., yellow, magenta, cyan and black disposed around the respective photosensitive drums 74. Downstream of the image forming portion 65, there are disposed a fixing apparatus 66 for fixing color toner images transferred from the photosensitive drums 74 to a sheet on the sheet, and a pair of discharging rollers for discharging the sheet.

Description of the Operation of the Copying Machine

When a sheet supplying signal is outputted from the apparatus main body 3 of the copying machine 1, a sheet is fed from a cassette 68 constituting the sheet supplying portion 64 to the pair of registration rollers 76. On the other hand, light applied from the light source and lens system 72 to the original placed on the original supporting stand 71 by a user and reflected therefrom is signal-processed via the light source and lens system 72, and thereafter is applied from a writing-in optical system (not shown) to the photosensitive drum 74. The photosensitive drum 74 is charged in advance by a primary charging device, and when light is applied thereto, an electrostatic latent image is formed thereon. The electrostatic latent image becomes a toner image by the photosensitive drum 74 being developed by the developing device 75.

The sheet fed from the sheet supplying portion 64 has its skew feeding corrected by the pair of registration rollers 76, and is fed into the image forming portion 65 in timed relationship with the position of the toner image on the photosensitive drum 74, and a color toner image on the photosensitive drum 74 is transferred thereto. Then, the sheet has the color toner image thereon permanently fixed by the fixing apparatus 66. The sheet having had the color toner image thereon fixed is discharged from the apparatus main body 3 by a pair of discharging rollers 63.

In this manner, the sheet fed from the sheet supplying portion 64 has a color toner image formed thereon and is fed from the apparatus main body 3 into the sheet treating apparatus 2.

(Sheet Treating Apparatus)

The sheet treating apparatus 2 is provided with a fixed tray 69 on which sheets discharged from the pair of discharge rollers 63 of the apparatus main body 3 of the copying machine 1 are intactly discharged and stacked, a stapler 70 for making the sheets discharged from the apparatus main body 3 into a bundle shape, and then binding the sheet bundle, a stack tray 78 as vertically movable stacking means on which the sheet bundle bound by the stapler 70 is discharged and stacked, a pamphlet making apparatus 79 for making the sheets discharged from the apparatus main body 3 into a bundle shape, and then binding the sheet bundle and twice-folding it and making it into a pamphlet, and a spine folded portion flattening apparatus 83 according to a first embodiment. The spine folded portion flattening apparatus 83 is installed below the stack tray 78 when in its elevated position.

The sheet treating apparatus 2 is adapted to be provided with spine folded portion flattening apparatuses 84 and 85 according to second and third embodiments, respectively, instead of the spine folded portion flattening apparatus 83 according to the first embodiment. Also, sheets made into a bundle shape without being bound by the stapler 70 are sometimes discharged to and stacked on the stack tray 78.

The pamphlet making apparatus 79 is adapted to pile up a plurality of sheets discharged from the pair of discharge rollers 63 of the apparatus main body 3 of the copying machine 1 and make them into a bundle shape, and then bind the sheet bundle at its middle by a stapler 62, and fold the sheet bundle in half with the bound portion as the center to thereby make the sheet bundle into a pamphlet shape. Also, in some cases, the sheets or the sheet bundle is simply folded in half and made into a pamphlet shape without being bound by the stapler 62.

The pamphlet making apparatus 79 successively receives and aligns the sheets send from the pair of discharge rollers 63 by a saddle tray 60 and makes them into a bundle shape. The aligned sheet bundle is saddle-stitched by the stapler 62, and has its stitched portion pushed by a push plate 61 and is pushed into the nip between a pair of folding rollers 59. The push plate 61 is retracted after it has pushed the sheet bundle into the nip between the pair of folding rollers 59. The pair of folding rollers 59 fold in half the sheet bundle pushed into therebetween while nipping and conveying the sheet bundle, and send it into the spine folded portion flattening apparatus 83. Alternatively, the sheet bundle simply folded in half without being saddle-stitched by the stapler 62 may be sent into the spine folded portion flattening apparatus 83.

The push plate 61 and the pair of folding rollers 59 together constitute a folding device 58 as folding means. The stapler 62, the folding device 58 and so on together constitute the pamphlet making apparatus 79.

Spine Folded Portion Flattening Apparatus According to the First Embodiment

Description of the Construction of the Spine Folded Portion Flattening Apparatus According To the First Embodiment As shown in FIGS. 1 to 7B, the spine folded portion flattening apparatus 83 is adapted to flatten the U-shaped curved spine folded portion (spine cover) Sb of the folio pamphlet-shaped sheet bundle sent from the pamphlet making apparatus 79.

The saddle-stitched folio sheet bundle is sent from the pamphlet making apparatus 79 shown in FIG. 1 to a stopper plate 17 (see FIGS. 2A and 2B) with the spine folded portion thereof as the leading edge by a pair of conveying belts 5 as conveying means. The stopper plate 17 as stopping means is a stopper for stopping and positioning the leading edge of the folded sheet bundle with respect to the conveying direction which is the spine folded portion. The stopper plate 17 is adapted to be vertically and horizontally moved as viewed in FIG. 3B by a drive source (not shown).

As shown in FIGS. 2A, 2B, 3A and 3B, a gripper holding arm 9 is slidably provided on slide shafts 15 and 16 fixed to the spine folded portion flattening apparatus 83. Also, the gripper holding arm 9 has a rack 9*a*. A pinion 11*a* provided on a driving motor 11 is in meshing engagement with the rack 9*a*. By the rotation of the driving motor 11, drive is transmitted from the pinion 11*a* to the rack 9*a*, whereby the gripper holding arm 9 slides.

Figure 3A:
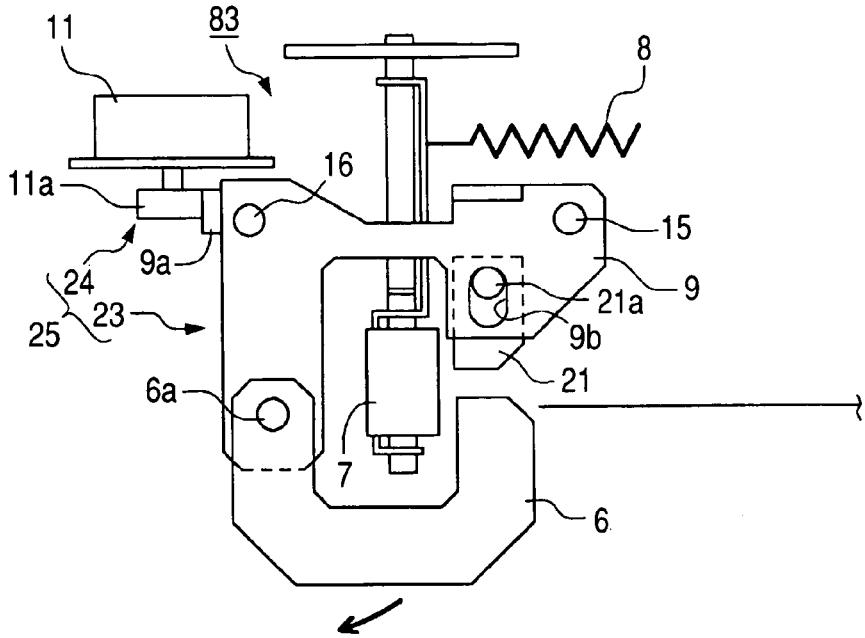
FIGS. 3A and 3B are front views of the spine folded portion flattening apparatus according to the first embodiment.
Figure 3B:
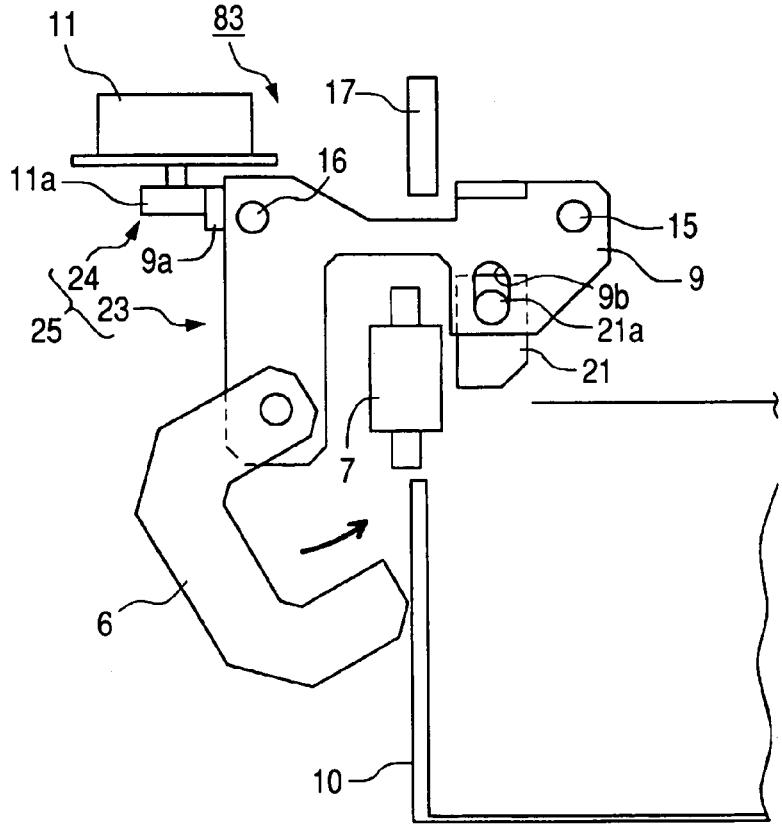

A pivotally movable gripper 6 is provided on a shaft 6*a* so as to rotate integrally with the shaft 6*a* rotatably supported on the gripper holding arm 9. The pivotally movable gripper 6 is adapted to receive the rotational force of a driving motor 18 provided on the gripper holding arm 9 through a drive gear 22 provided on the driving motor 18, a driven gear 19 meshing with the drive gear 22 and integral with the shaft 6*a*, and the shaft 6*a*, and be rotated as shown in FIGS. 3A and 3B.

A vertically movable gripper 21 is provided with a shaft portion 21*a* engaged with the slot 9*b* of the gripper holding arm 9, and is vertically movably supported by the gripper holding arm 9. Also, the vertically movable gripper 21 is supported by the gripper holding arm 9 so as to provide pressure in a downward direction as viewed in FIGS. 3A and 3B by pressurizing means (not shown). Further, the vertically movable gripper 21 is adapted to cooperate with the pivotally movable gripper 6 to grip the folio sheet bundle.

It is preferable that the pivotally movable gripper 6 and the vertically movable gripper 21 have a length equal to or greater than the length of the spine folded portion of the sheet bundle S in the longitudinal direction thereof. Thus, the pivotally movable gripper 6 and the vertically movable gripper 21 can reliably nip the whole of the spine folded portion of the sheet bundle S in the longitudinal direction thereof, and even if the spine folded portion is pressed by a shaping roller 7, the spine folded portion rarely escapes at the end portion in the longitudinal direction and can be easily flattened.

In the above-described construction, the pivotally movable gripper 6, the vertically movable gripper 21 and so on together constitute a gripping device 23 as gripping means for gripping at least the vicinity of the spine folded portion of the whole of the opposite surfaces of the sheet bundle S. The gripping device 23 is designed such that the pivotally movable gripper 6 is rotated and grips the sheet bundle S, but it may be designed such that the vertically movable gripper 21 is rotated and grips the sheet bundle. What is essential is a construction in which when the sheet bundle S has received the pressing force of the shaping roller 7, it is adapted to be reliably gripped by the pivotally movable gripper 6 and the vertically movable gripper 21 so that the position thereof may not deviate.

The driving motor 11, the pinion 11*a* and the rack 9*a* and so on together constitute a grip moving device 24 as grip moving means for moving the gripping device 23 in a direction along the spine folded portion Sb of the sheet bundle S. The gripping device 23 and the grip moving device 24 together constitute a moving device 25 as moving means for moving the sheet bundle S in the direction along the spine folded portion Sb. The gripping device 23 is adapted to be reciprocally movable in a horizontal direction as viewed in FIGS. 2A and 2B.

Figure 2A:
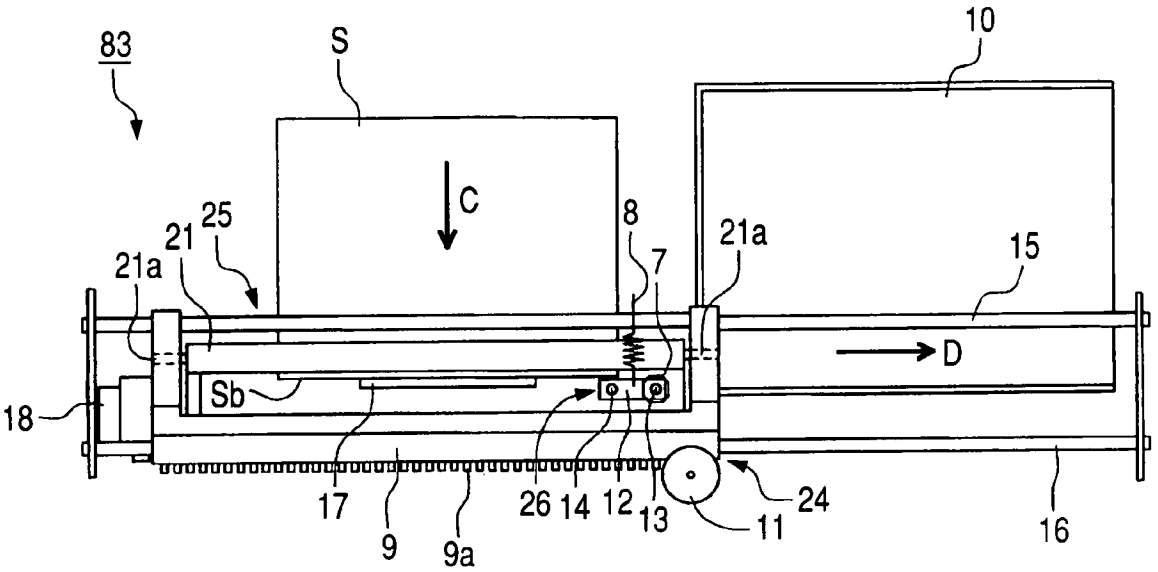
FIGS. 2A and 2B show a spine folded portion flattening apparatus according to a first embodiment of the present invention, FIG. 2A being a plan view, and FIG. 2B being a side view.
Figure 2B:
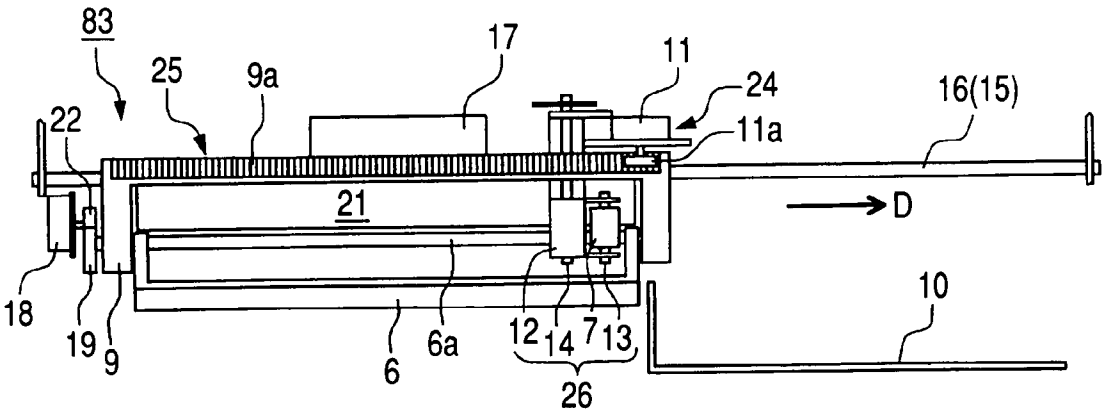
Figure 5:
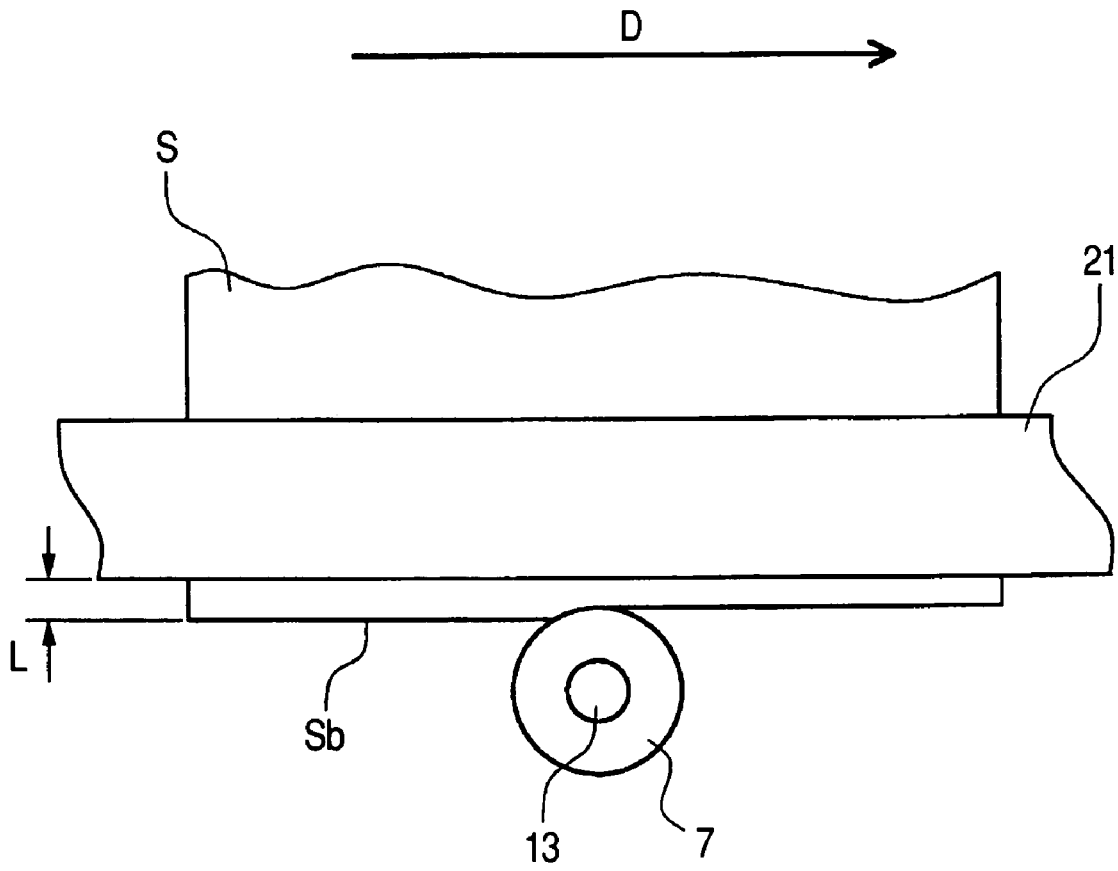
FIG. 5 shows a state when, in the spine folded portion flattening apparatus according to the first embodiment, the spine folded portion of the sheet bundle is being flattened by a shaping roller.

The shaping roller 7 as a rotary member, as shown in FIG. 5, is adapted to press the U-shaped curved spine folded portion Sb of the folded sheet bundle S to thereby compress and deform it into a flat shape. As shown in FIGS. 2A and 2B, the shaping roller 7 is rotatably provided on a shaft 13 provided on a supporting plate 12. The supporting plate 12 is rotatably supported on a fixed shaft 14 and is adapted to be drawn toward the vertically movable gripper 21 by a tension spring 8 to thereby bring the shaping roller 7 into pressure contact with the spine folded portion Sb of the sheet bundle S. Also, the supporting plate 12, when the shaping roller 7 is not in contact with the spine folded portion Sb, is stopped by a stopper (not shown) so as not to be pulled by the tension spring 8 and over-rotated. The outer periphery of the shaping roller 7 is located more adjacent to the vertically movable gripper 21 than to the spine folded portion Sb of the sheet bundle S stopped by the stopper plate 17, in FIG. 2A.

The shaping roller 7 may simply rotatably supported on a fixed supporting plate.

The shaping roller 7, the tension spring 8, and so on together constitute a sheet pressing apparatus 26 as pressing means for pressing the spine folded portion of the sheet bundle.

Description of the Operation of the Spine Folded Portion Flattening Apparatus

Figure 6A:
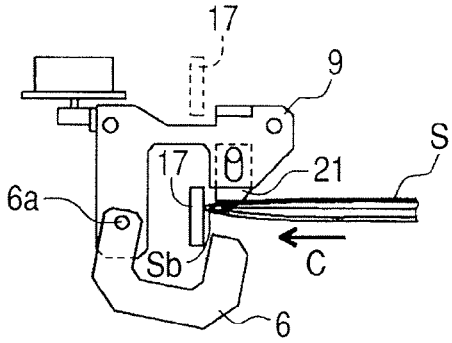
FIGS. 6A, 6B, 6C and 6D are front views for illustrating the operation of the spine folded portion flattening apparatus according to the first embodiment.

The operation of the spine folded portion flattening apparatus will now be described with reference to FIGS. 4A, 4B, 5 and 6A-6D. The sheet bundle S saddle-stitched by the stapler 62 and folded by the folding device 58 (see FIG. 1) is inserted in the direction indicated by the arrow C between the pair of pivotally movable gripper 6 and vertically movable gripper 21 opened as shown in FIG. 6A, by a pair of conveying belts 5. At this time, the stopper plate 17 stops the spine folded portion Sb which is the leading edge of the sheet bundle S with respect to the conveying direction thereof, and positions the spine folded portion Sb of the sheet bundle.

The pair of conveying belts 5 convey the sheet bundle S by a predetermined distance after the leading edge of the sheet bundle S with respect to the conveying direction thereof has been detected by a sensor (not shown) provided on this side of the stopper plate 17, and thereafter stop the conveyance of the sheet bundle S. The stopped position of the sheet bundle S can be set by only the counting of the number of revolutions of a conveying motor (not shown) for driving the pair of conveying belts 5, but is more preferable that the conveyed sheet bundle S be rammed against the stopper plate 17 such as the skew feed thereof being corrected, and be positioned thereof.

Figure 6B:
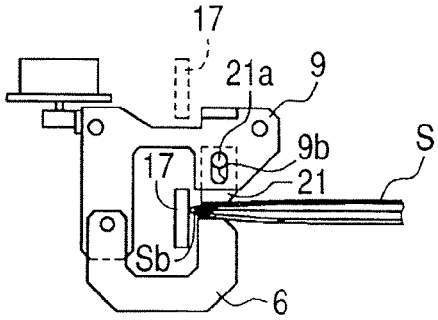

When the sheet bundle S is positioned, as shown in FIG. 6B, the pivotally movable gripper 6 is rotated toward the sheet bundle S side and pushes up the vertically movable gripper 21 with the sheet bundle S interposed therebetween, and cooperates with the vertically movable gripper 21 to grip the sheet bundle S. The pivotally movable gripper 6 is rotated to and stopped in a position in which it can cooperate with the vertically movable gripper 21 to grip the sheet bundle with a predetermined gripping force. Design may be made such that the interval between the stopper plate 17 and the pivotally movable gripper 6 and between the stopper plate 17 and the vertically movable gripper 21 can be adjusted to thereby adjust the amount of protrusion of the sheet bundle S from the left side of the pivotally movable gripper 6 and the vertically movable gripper 21.

Figure 6C:
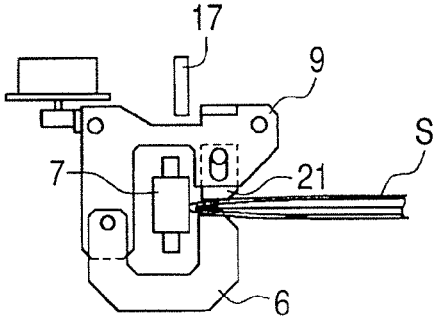

When the gripping operation by the pivotally movable gripper 6 and the vertically movable gripper 21 is completed, the stopper plate 17 is upwardly retracted as shown in FIG. 6C. The stopper plate 17 need not always be retracted, but may remain having stopped the sheet bundle.

When the stopper plate 17 is upwardly retracted, the leading edge (spine folded portion Sb) of the sheet bundle S with respect to the conveying direction thereof which has so far been pushed against the stopper plate 17 and more or less compressed is liberated and is restored to its original state, and protrudes by a predetermined amount (distance L, see FIG. 5) from the left side of the pivotally movable grippers 6 and the vertically movable gripper 21. This distance L is a distance for the spine folded portion Sb of the sheet bundle S to reliably strike against the outer periphery of the shaping roller 7. Also, the distance L is such a distance that even if pressed by the shaping roller 7, the spine folded portion Sb of the sheet bundle S can be easily flattened without escaping.

Figure 4A:
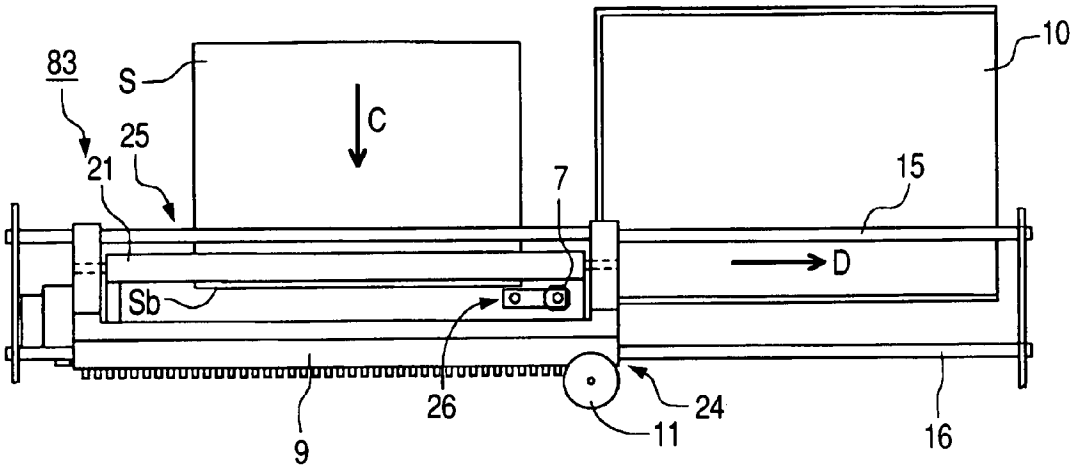
FIGS. 4A and 4B are plan views of the spine folded portion flattening apparatus according to the first embodiment.
Figure 4B:
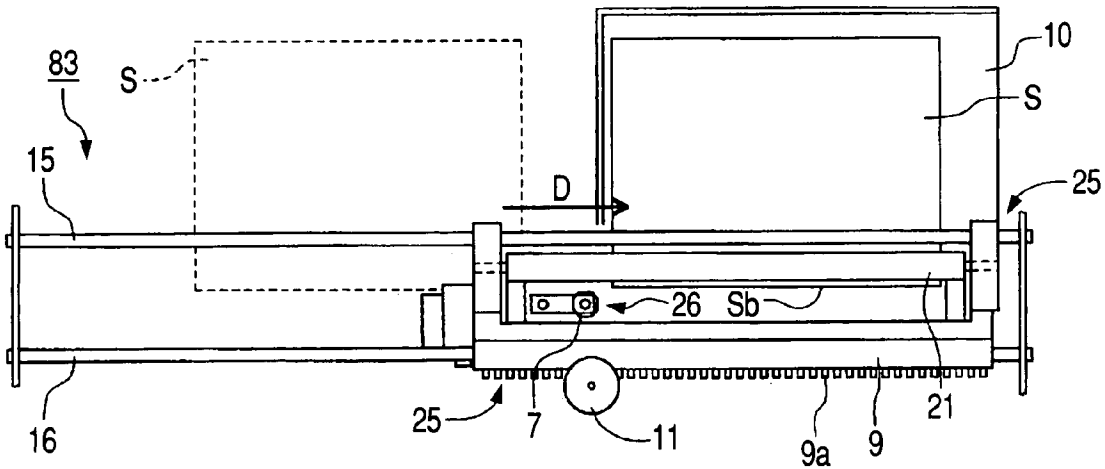

Next, as shown in FIGS. 4A and 4B, the gripper holding arm 9 is moved in the direction indicated by the arrow D from a position shown in FIG. 4A to a position (the discharged position of the sheet bundle) shown in FIG. 4B by the driving motor 11. The gripper holding arm 9 is provided with the pivotally movable gripper 6 and the vertically movable gripper 21 and therefore, the gripper holding arm 9 is moved with the sheet bundle remaining gripped by the pivotally movable gripper 6 and the vertically movable gripper 21. That is, the sheet bundle S is moved from the position of broken line to the position of solid line in FIG. 4B. At this time, as shown in FIGS. 5 and 6C, the folded sheet bundle S is moved in the direction indicated by the arrow D in such a manner that the arcuate spine folded portion Sb contacts with the shaping roller 7 and pushes the shaping roller 7 aside against the traction force of the tension spring 8 shown in FIG. 2A. The shaping roller 7 presses the U-shaped curved spine folded portion Sb of the passing sheet bundle and compresses and deforms it into a flat shape.

Figure 6D:
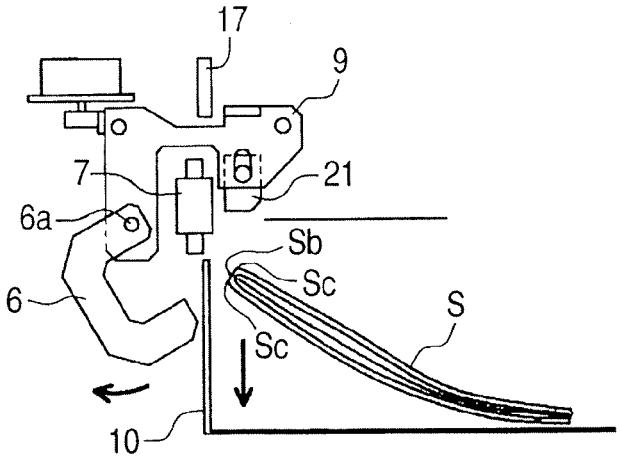

When the gripper holding arm 9 is moved to a discharging position shown in FIG. 4B, the spine folded portion Sb of the sheet bundle S is flatly formed and the spine folded portion flattening process is completed. Also, the sheet bundle has its spine folded portion pressed by the shaping roller 7 with the vicinity of the spine folded portion nipped by and between the pivotally movable gripper 6 and the vertically movable gripper 21 and therefore, cornering is done to the end portion Sc of the spine folded portion Sb in the direction of the thickness thereof (see FIG. 6D). Thereafter, as shown in FIG. 6D, the pivotally movable gripper 6 is downwardly rotated, and liberates the sheet bundle S it has cooperated with the vertically movable grip 21 to grip, and discharges the sheet bundle to a sheet discharging tray portion 10 disposed downstream of the gripper holding arm 9 with respect to the direction of movement thereof. A portion of the sheet discharging tray portion 10 protrudes to the outside of the sheet treating apparatus 2, as shown in the appearance view of the copying machine 1 shown in FIG. 7B.

Figure 7A:
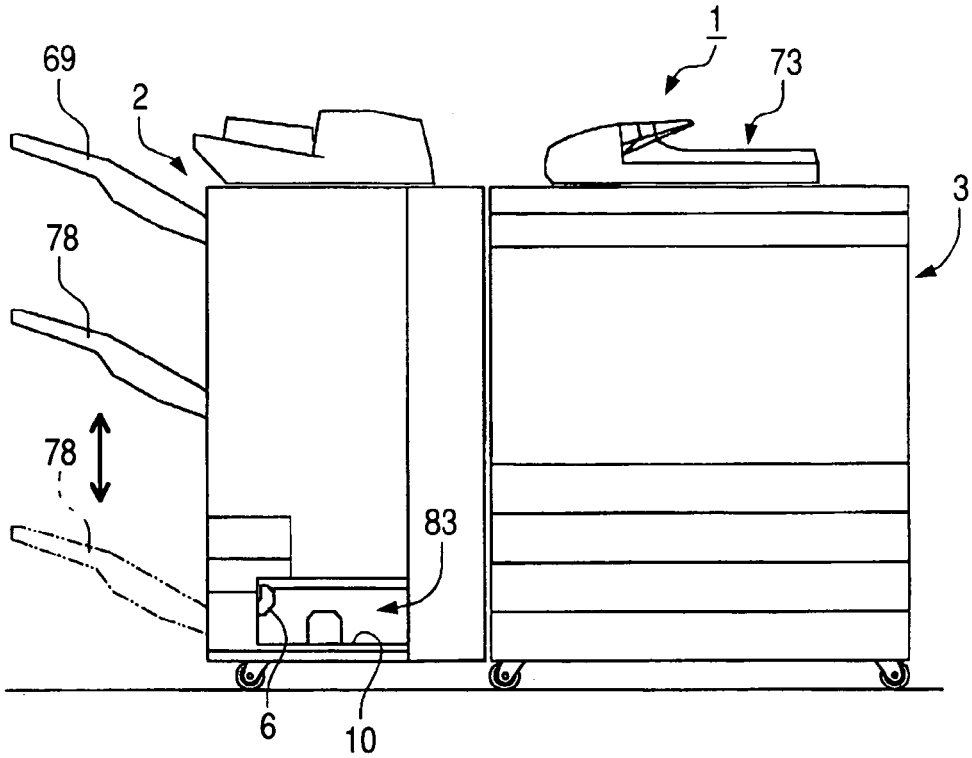
FIGS. 7A and 7B show the appearance of the copying machine which is an example of the image forming apparatus provided with the spine folded portion flattening apparatus of the present invention, FIG. 7A being a front view, and FIG. 7B being a left side view of FIG. 7A.
Figure 7B:
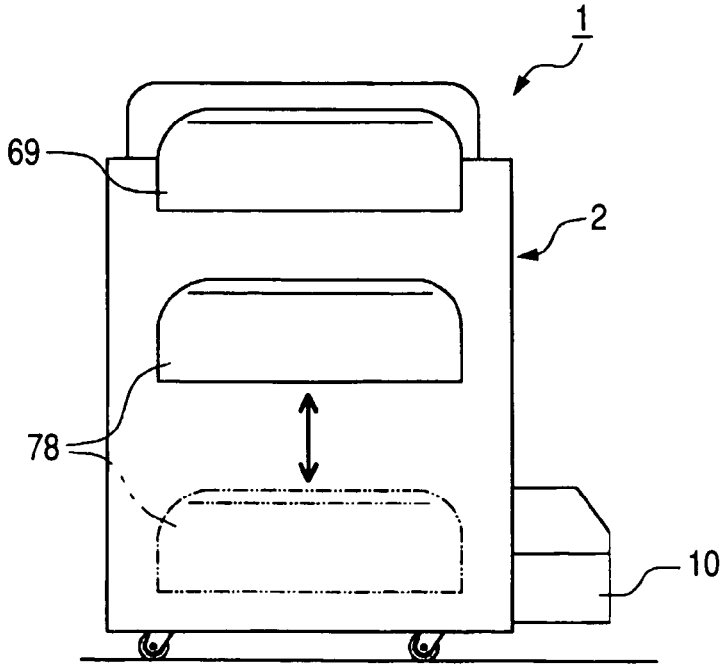

In this manner, the spine folded portion flattening apparatus 83 sequentially carries out the process of flattening the spine folded portion of the sheet bundle, and discharges and stacks the sheet bundle to the sheet discharging tray portion 10 partly protruding to the front of the sheet treating apparatus 2, as shown in the appearance view of FIGS. 7A and 7B showing the copying machine 1.

As describing above, the spine folded portion flattening apparatus 83 according to the present embodiment is adapted to grip the sheet bundle folded by the folding apparatus 58 by the pair of pivotally movable gripper 6 and vertically movable gripper 21, and move it in such a manner as to push the shaping roller 7 aside by the spine folded portion, and flatten the spine folded portion by the shaping roller 7 and discharge the sheet bundle to the sheet discharging tray portion 10 and therefore, can effect the conveyance of the sheet bundle and the spine folded portion flattening process at a time. Thus, the spine folded portion flattening apparatus 83 according to the present embodiment, as compared with the conventional spine folded portion flattening apparatus which carries out the flattening process with the sheet bundle stopped, can improve the spine folded portion flattening process efficiency. Also, it becomes unnecessary to widen the conveyance interval between sheet bundles and therefore, the sheet bundle conveying efficiency can also be enhanced.

The spine folded portion flattening apparatus 83 according to the present embodiment is adapted to stop the spine folded portion of the sheet bundle conveyed by the pair of conveying belts 5 by the stopper plate 17, and thereafter move the sheet bundle by the sheet bundle moving apparatus 25, and press and compress the spine folded portion of the sheet bundle by the shaping roller 7 during the movement of the sheet bundle to thereby flatten it and therefore, can accurately position the spine folded portion of the sheet bundle by the stopper plate 17 and reliably bring the spine folded portion into contact with the shaping roller 7, thus reliably flattening the spine folded portion.

In the spine folded portion flattening apparatus 83 according to the present embodiment, the moving device 25 is constituted by the gripping device 23 for gripping the opposite surfaces of the sheet bundle, and the grip moving device 24 for moving the gripping apparatus 23 in a direction along the spine folded portion and therefore, the cover and the back cover can be gripped near the spine folded portion by the gripping device 23, and it is made difficult for the cover and the back cover near the spine folded portion to escape even if the spine folded portion is pressed by the shaping roller 7. Thus, the spine folded portion can be flattened easily. Also, the belt portion of the sheet bundle which bulges out and has become U-shaped can be squeezed by the gripping device 23 to thereby make the sheet bundle into a shape which readily permits if to be piled up.

The spine folded portion flattening apparatus 83 according to the present embodiment is adapted to press and flatten the spine folded portion of the bundle sheet by the shaping roller 7 rotated with the movement of the sheet bundle and therefore, can flatten the spine folded portion without damaging the spine folded portion.

Also, the sheet treating apparatus 2 is provided with the spine folded portion flattening apparatus 83 enhanced in the process efficiency of flattening the spine folded portion of the sheet bundle and the sheet bundle conveying efficiency and therefore, can speed up the sheet bundle folding operation of the folding apparatus 58 to thereby enhance the sheet treating efficiency.

Further, the copying machine 1 is provided with the spine folded portion flattening apparatus 83 enhanced in the process efficiency of flattening the spine folded portion of the sheet bundle and the sheet bundle conveying efficiency and therefore, can enhance the image forming efficiency of forming an image on the sheet.

Also, the spine folded portion flattening apparatus 83 according to the present embodiment, as shown in FIG. 4A, is adapted to discharge the sheet bundle conveyed in the direction indicated by the arrow C to the sheet discharging tray portion 10 with the conveying direction changed to the direction indicated by the arrow D by about 90°. Thus, the sheet discharging tray portion 10, as shown in FIGS. 7A and 7B, can be installed not beneath the stack tray 78, but on this side of the sheet treating apparatus 2, and does not hinder the downward movement of the stack tray 78. Thereby, it becomes possible to install the spine folded portion flattening apparatus 83 which has heretofore unavoidably been installed below the downwardly moved position of the stack tray 78, below the stack tray 78 when in its elevated position, and the dimensions in the height direction thereof can be made small, and this contributes to the downsizing of the sheet treating apparatus.

Therefore, the sheet treating apparatus 2 and the copying machine 1 provided with the spine folded portion flattening apparatus 83 according to the present embodiment are widened in the upward and downward movement area of the stack tray 78, and can increase the number of sheets stacked on the stack tray 78. Further, in the case of the copying machine 1, it becomes unnecessary to increase the left-to-right length of the front thereof.

Even if instead of the spine folded portion flattening apparatus 83 according to the first embodiment any one of spine folded portion flattening apparatus 84 and 85 according to second and third embodiments which will be described later is provided in the sheet treating apparatus 2, the sheet treating apparatus 2 can speed up the sheet bundle folding operation of the folding apparatus 58 to thereby enhance the sheet treating efficiency. It also can increase the number of sheets stacked on the stack tray 78.

Also, even if instead of the spine folded portion flattening apparatus 83 according to the first embodiment, any one of the spine folded portion flattening apparatuses 84 and 85 according to the second and third embodiments which will be described later is provided in the copying machine 1, there can be obtained similar effects such as the enhancement of the image forming efficiency, the increase in the number of sheets stacked on the stack tray 78, and the increase in the left-to-right length of the front.

Spine Folded Portion Flattening Apparatus According to the Second Embodiment

Description of the Construction of the Spine Folded Portion Flattening Apparatus According to the Second Embodiment As shown in FIGS. 8A, 8B and 9 to 11, the spine folded portion flattening apparatus 84 according to the second embodiment is also adapted to flatten the U-shaped curved spine folded portion (spine cover) Sb of a folio pamphlet-shaped sheet bundle sent thereto from the pamphlet making apparatus 79.

The spine folded portion flattening apparatus 84 according to the second embodiment differs in the construction of the gripping apparatus from the spine folded portion flattening apparatus 83 according to the first embodiment. That is, the gripping device 23 of the spine folded portion flattening apparatus 83 according to the first embodiment uses a pair of grippers 6 and 21, whereas the sheet gripping apparatus 88 of the spine folded portion flattening apparatus 84 according to the second embodiment uses a drive conveying belt 32 and a driven conveying belt 31 facing each other as a pair of rotary members. The differing portion will hereinafter be described and the other portions need not be described.

Figure 10:
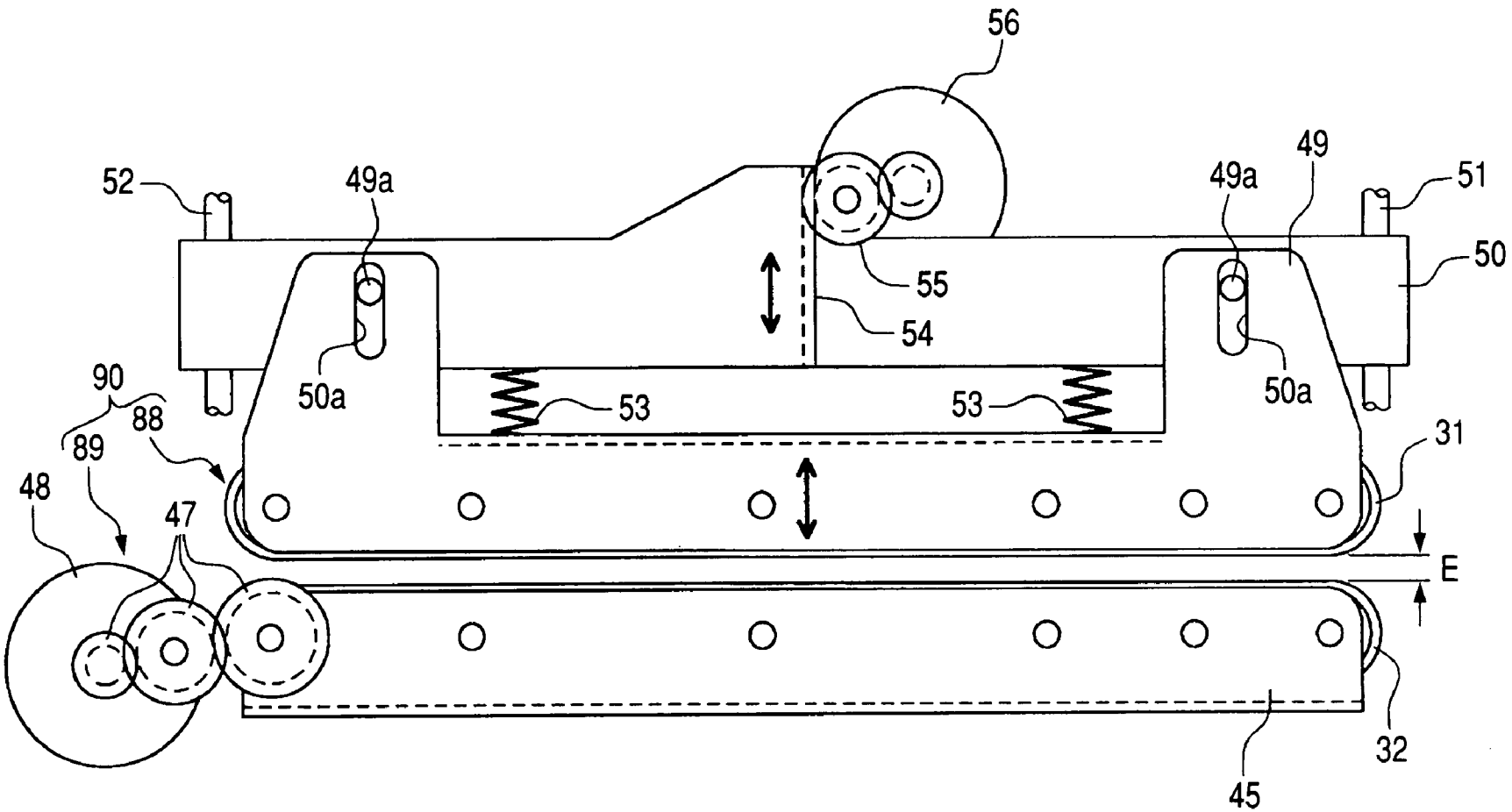
FIG. 10 is a side view of the moving device of the spine folded portion flattening apparatus according to the second embodiment.
Figure 11:
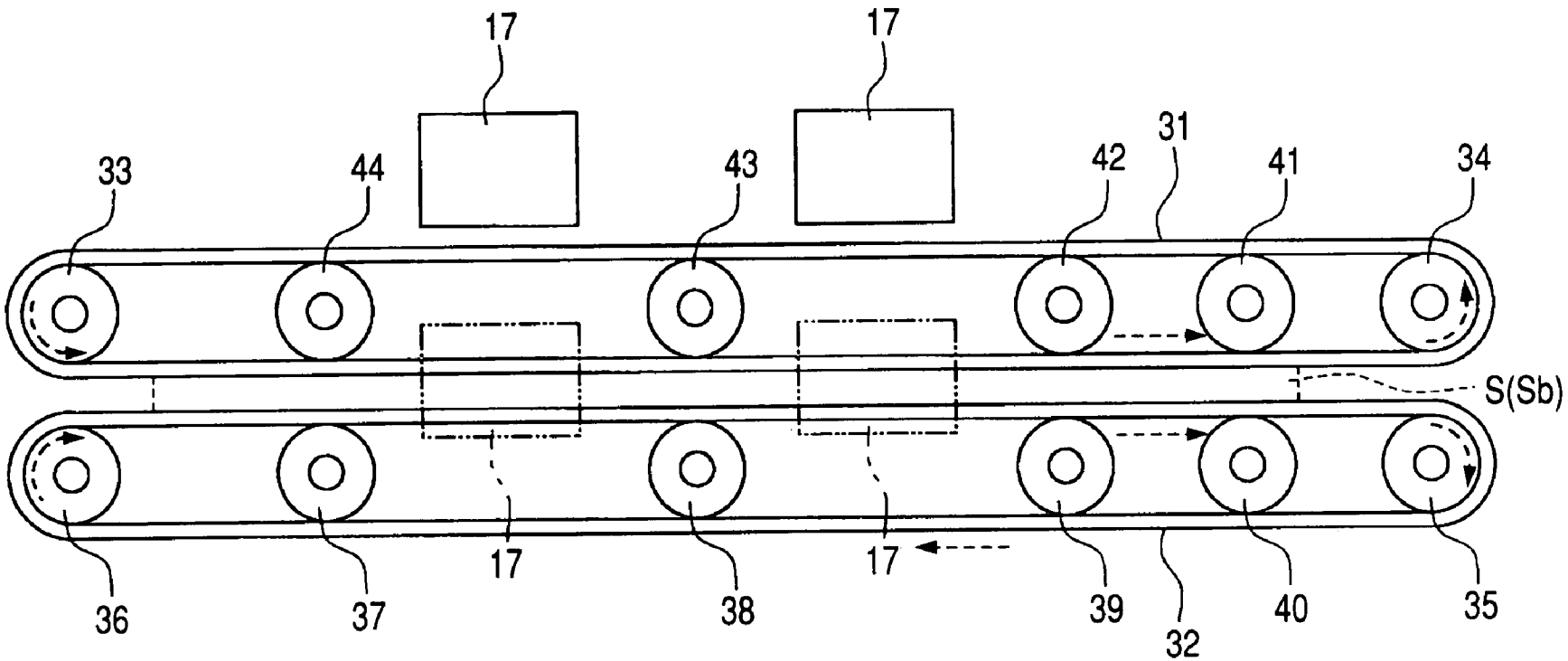
FIG. 11 shows a pair of belts in FIG. 10.

As described in FIGS. 10 and 11, the drive conveying belt 32 is passed over a drive roller 36 provided on a fixed shaping support arm 45 and an extending roller 35 rotatable by being driven. The drive roller 36 is adapted to receive the rotational force of a driving motor 48 through a gear train 47 and be rotated. The intermediate portion of the drive conveying belt 32 is supported by a plurality of pressure contact rollers 37, 38, 39 and 40 rotatably provided on the shaping support arm 45.

The driven conveying belt 31 is passed over a driven roller 33 and an extending roller 34 rotatably provided on a shaping support arm 49. The intermediate portion of the driven conveying belt 31 is supported by a plurality of pressure contact rollers 41, 42, 43 and 44 rotatably provided on the shaping support arm 49. The driven conveying belt 31 is adapted to be brought into pressure contact with the drive conveying belt 32 with the sheet bundle interposed therebetween by a pressure contact spring 53 for biasing the shaping support arm 49 toward the drive conveying belt 32 side. Therefore, the pressure contact rollers 41, 42, 43, 44 and the pressure contact rollers 37, 38, 39, 40 are all provided at locations opposed to each other with the belts 31, 32 and the sheet bundle interposed therebetween.

Thus, the whole of the spine folded portion in the longitudinal direction thereof can be reliably nipped by and between the drive conveying belt 32 and the driven conveying belt 31, and even if the spine folded portion is pressed by the shaping roller 7, the spine folded portion rarely escapes aside and can be easily flattened. Also, it is preferable that the distance between the centers of the drive roller 36 and the extending roller 35 and the distance between the centers of the driven roller 33 and the extending roller 34 be equal to or greater than the length of the spine folded portion of the sheet bundle along the longitudinal direction thereof.

The shaping support arm 49 is provided on a slide arm 50 for upward and downward movement by the engagement between a slide shaft 49*a* and a vertical slot 50*a*. The slide arm 50 is upwardly and downwardly movable provided on fixed slide shafts 51 and 52. Also, the slide arm 50 is adapted to receive the rotational force of a driving motor 56 as a rectilinear kinetic force through a pinion 55 and a rack 54 and be moved up and down thereby.

Description of the Operation of the Spine Folded Portion Flattening Apparatus According to the Second Embodiment When a folded sheet bundle has not been conveyed to the spine folded portion flattening apparatus 84, this apparatus 84 makes the driven conveying belt 31 wait at a position separate from the drive conveying belt 32. At this time, the interval E (see FIG. 10) between the driven conveying belt 31 and the drive conveying belt 32 is equal to or greater than the thickness of the sheet bundle.

Figure 8A:
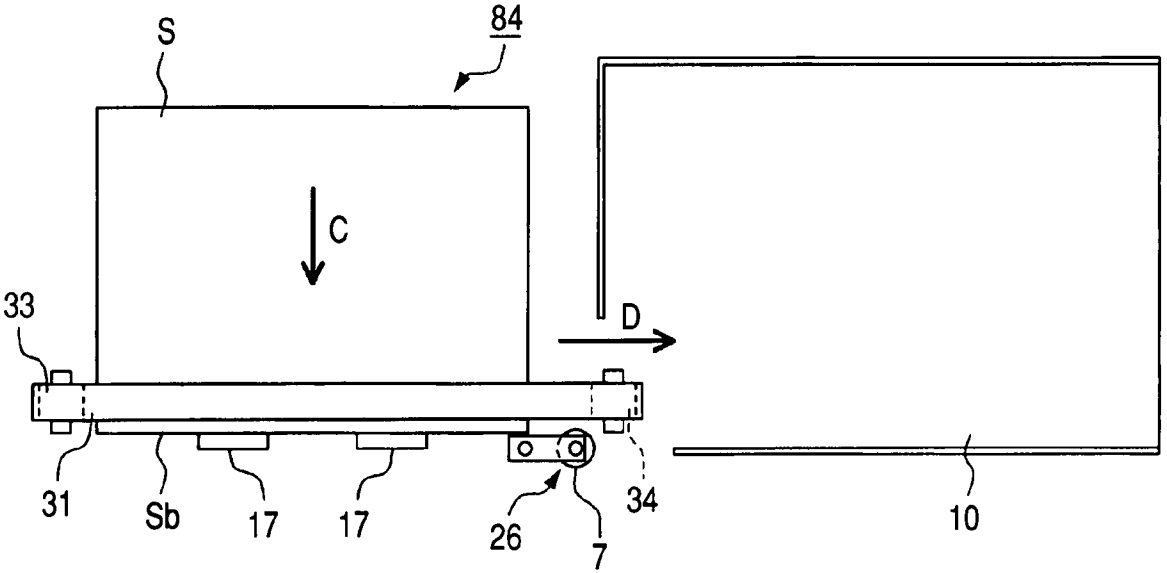
FIGS. 8A and 8B show a spine folded portion flattening apparatus according to a second embodiment of the present invention, FIG. 8A being a plan view, and FIG. 8B being a side view.
Figure 8B:
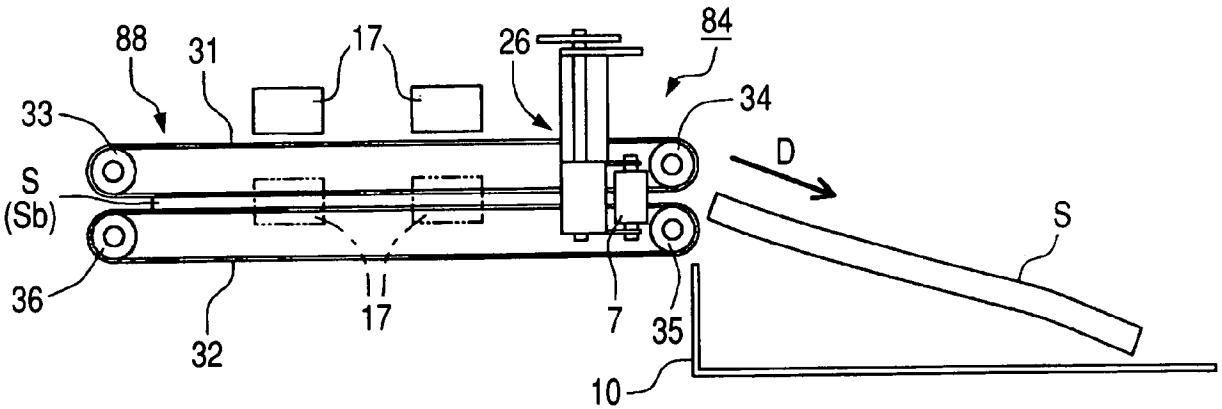

As shown in FIG. 8A, the folded sheet bundle S conveyed from the direction indicated by the arrow C is stopped and positioned by the stopper plates 17. At this time, the stopper plates 17 are in the positions of broken lines, as shown in FIGS. 8B and 11. Thereafter, the driving motor 56 is rotated. The slide arm 50 is moved down by the rotation of the driving motor 56. The shaping support arm 49 is also moved down through the pressure contact spring 53. Then, the driven conveying belt 31 urges the sheet bundle against the drive conveying belt 32 by the resilient force of the pressure contact spring 53. The driven conveying belt 31 and the drive conveying belt 32 grip the sheet bundle therebetween. When the pair of belts 31 and 32 grip the sheet bundle therebetween, the stopper plates 17 are upwardly retracted from the positions of broken lines to the positions of solid lines. The stopper plates 17 need not always be retracted. They may remain having stopped the sheet bundle.

Next, when the driving motor 48 is rotated, the drive conveying belt 32 is circulated by the rotation of the driving motor 48, whereby the sheet bundle S is conveyed and the drive conveying belt 31 is driven to circulate. The sheet bundle S is conveyed in the direction indicated by the arrow D as shown in FIGS. 8A and 8B, and is discharged to the sheet discharging tray 10. At this time, the sheet bundle S is conveyed in the direction indicated by the arrow D in such a manner as to push the shaping roller 7 aside by the spine folded portion Sb. The construction in which the shaping roller 7 is supported and biased toward the sheet bundle side is substantially the same as the pressing apparatus 26 shown in FIGS. 2A and 2B and therefore need not be described.

When the pair of belts 31 and 32 moves the sheet bundle to the discharging position indicated in FIG. 8B, the spine folded portion Sb of the sheet bundle S is formed flatly, whereby the spine folded portion flattening process is completed.

Figure 9:
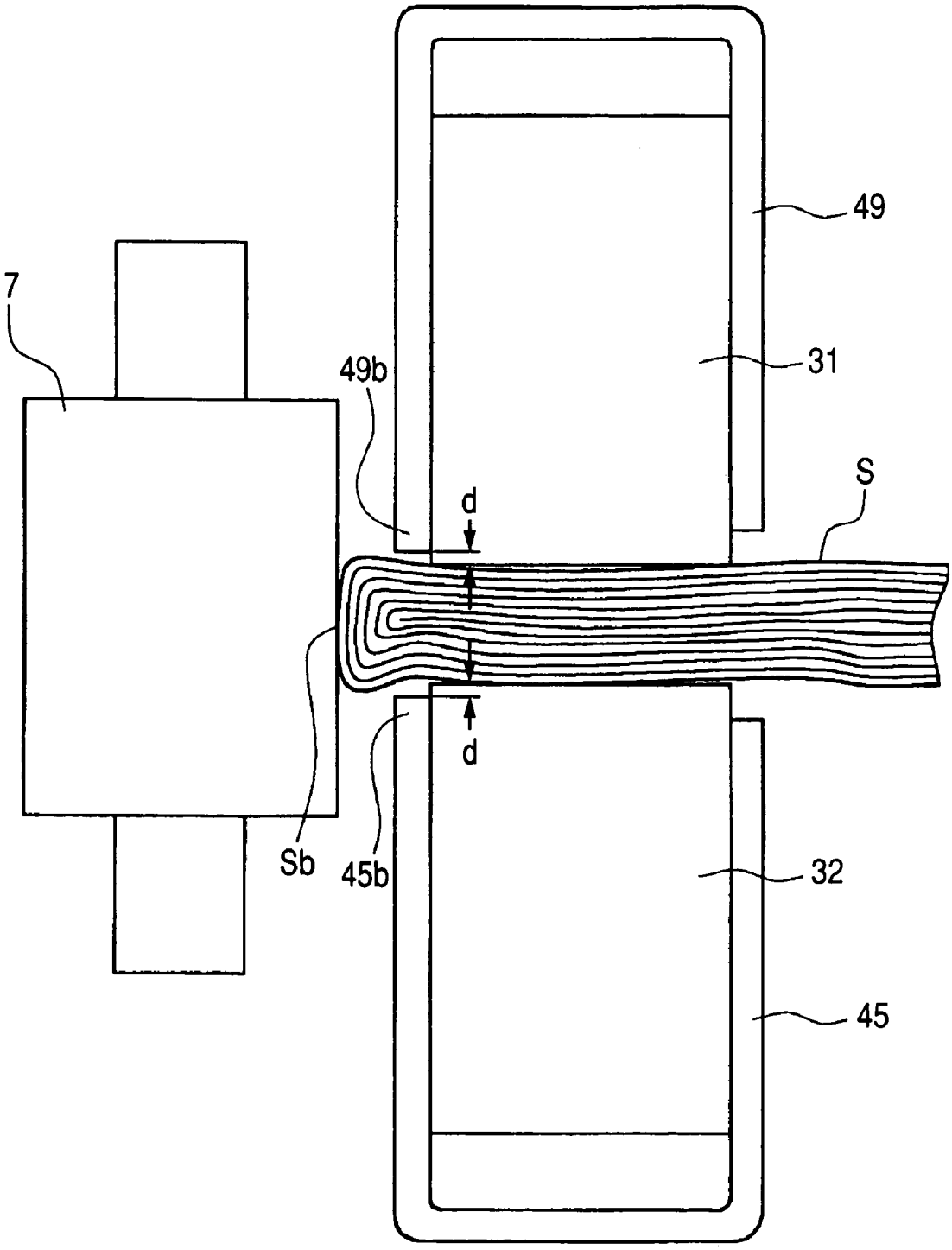
FIG. 9 is a schematic enlarged front view of the spine folded portion flattening apparatus according to the second embodiment when it is flattening a spine folded portion.

As shown in FIG. 9, the driven conveying belt 31 and the drive conveying belt 32 protrude by a predetermined dimension "d" from the lower end portion 49*b* of the shaping support arm 49 on the shaping roller 7 side and the upper end portion 45*b* of the shaping support arm 45, respectively. This is for preventing the lower end portion 49*b* and the upper end portion 45*b* from contacting with the sheet bundle S to thereby damage the sheet bundle. It is also for preventing the driven conveying belt 31 and the drive conveying belt 32 from being pushed by the spine folded portion Sb receiving a pressure force from the shaping roller 7 and escaping, to thereby ensure the spine folded portion flattening process by the shaping roller 7 to be reliably effected. Incidentally, the above-mentioned dimension "d" should preferably be about 0.01 mm to about 3 mm.

As shown in FIG. 10, the driving motor 56, the driven conveying belt 31 and the drive conveying belt 32 and so on together constitute a gripping device 88 as gripping means for gripping at least the vicinity of the spine folded portion, of the whole of the opposite surfaces of the sheet bundle. The driving motor 48, the driven conveying belt 31 and the drive conveying belt 32 and so on together constitute a grip moving device 89 as grip moving means. The gripping device 88 and the grip moving device 89 together constitute a moving device 90 as moving means.

As described above, the spine folded portion flattening apparatus 84 according to the present embodiment is adapted to press the spine folded portion Sb to thereby flatten the U-shaped curved spine folded portion (spine cover) of the folio sheet bundle while nipping the cover and spine cover of the sheet bundle S by and between the pair of belts 31 and 32 and conveying the sheet bundle, and discharge the sheet bundle to the sheet discharging tray portion 10. Therefore, the spine folded portion flattening apparatus 84 according to the present embodiment can effect the conveyance of the bundle sheet and the spine folded portion flattening process at a time, and can improve the sheet treating efficiency as compared with the conventional spine folded portion flattening apparatus which stops the sheet bundle and effects the spine folded portion flattening process. Also, it becomes unnecessary to widen the conveyance interval between sheet bundles and therefore, the sheet bundle conveying efficiency can also be enhanced.

Further, the moving device 25 of the spine folded portion flattening apparatus 83 according to the first embodiment requires a moving space in the direction indicated by the arrow D, whereas the pair of belts 32 and 31 of the spine folded portion flattening apparatus 84 according to the second embodiment are adapted to circulate and thereby convey the sheet bundle and therefore, does not require the moving space. Accordingly, the spine folded portion flattening apparatus 84 according to the second embodiment can make the operation space thereof smaller than the spine folded portion flattening apparatus 83 according to the first embodiment. Along therewith, the installation space for the sheet treating apparatus in the spine folded portion flattening apparatus 84 according to the present embodiment can be made small.

Spine Folded Portion Flattening Apparatus According to the Third Embodiment

Figure 12A:
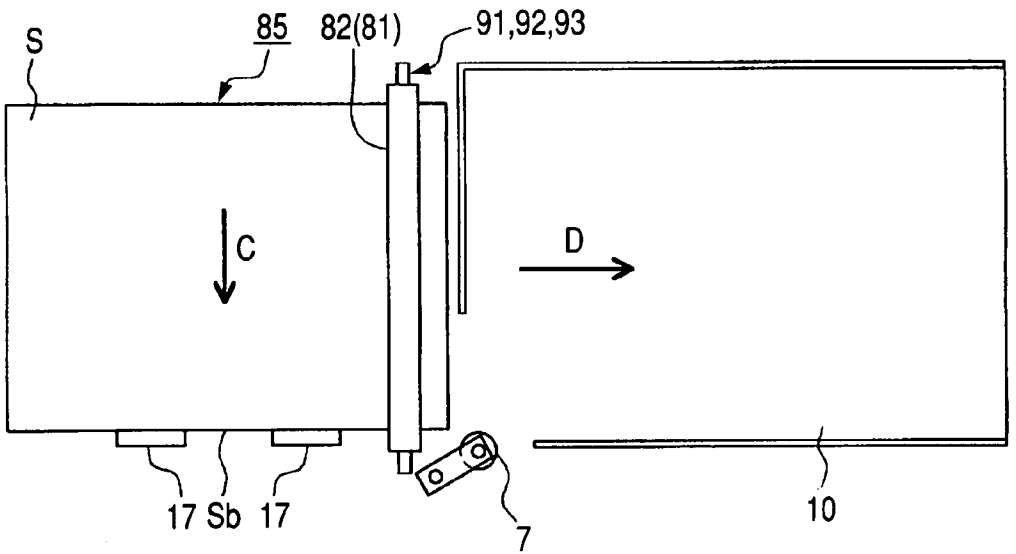
FIGS. 12A and 12B show a spine folded portion flattening apparatus according to a third embodiment of the present invention, FIG. 12A being a plan view, and FIG. 12B being a side view.
Figure 12B:
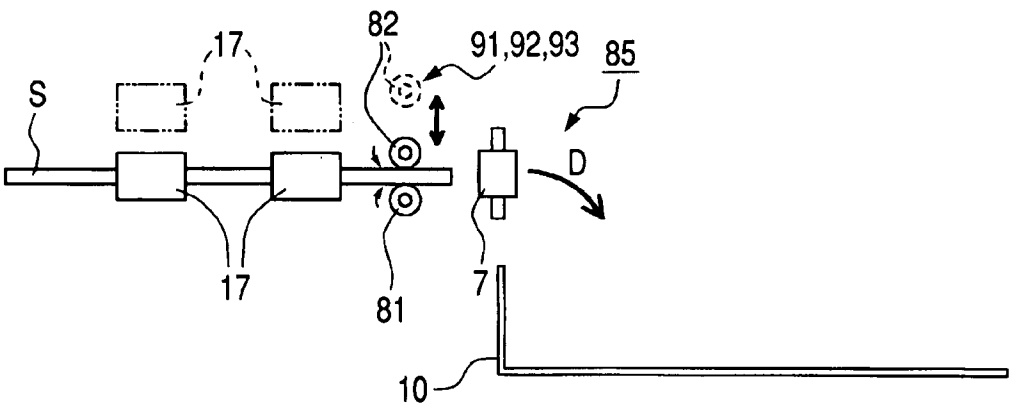
Figure 13:
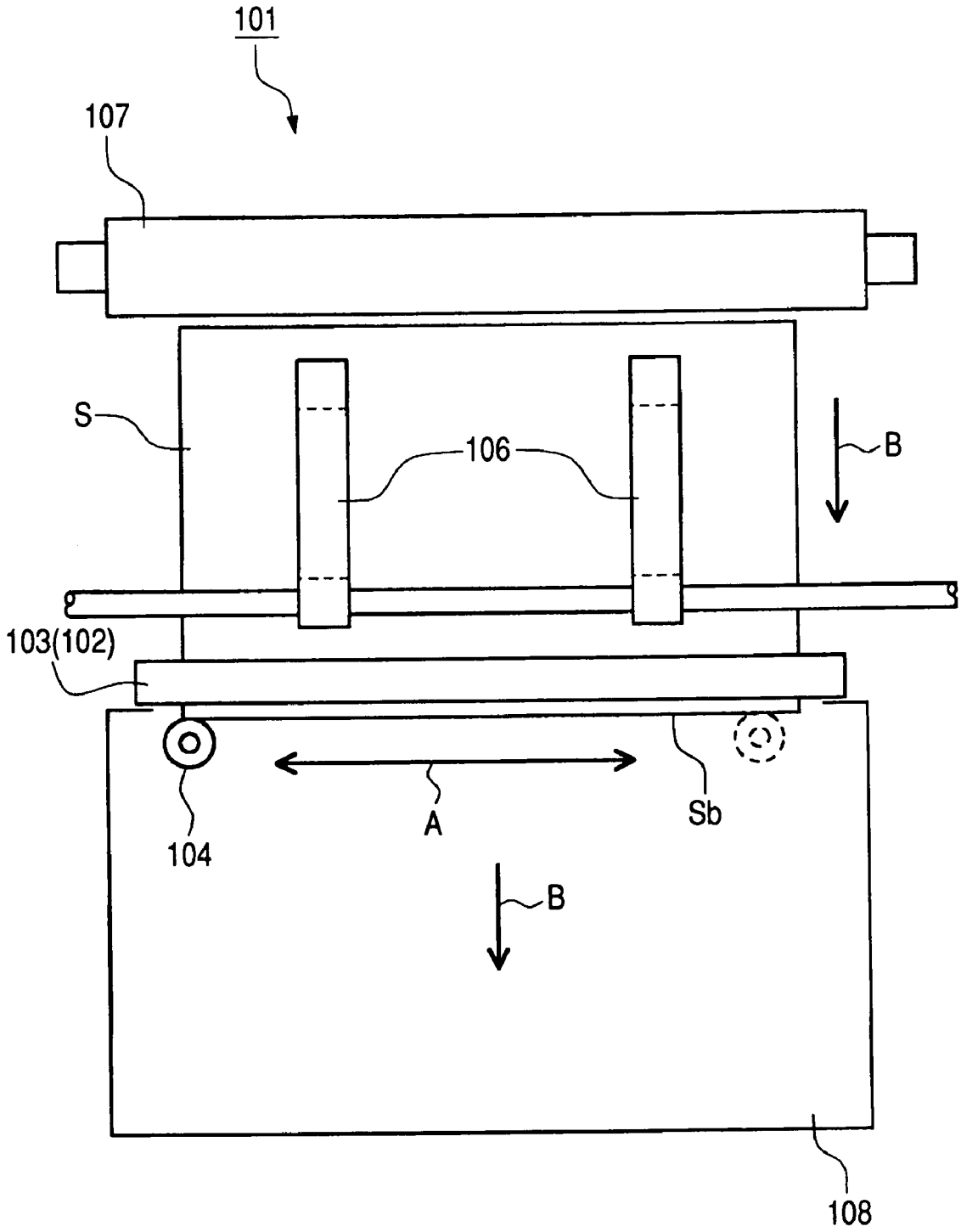
FIG. 13 is a plan view of a conventional spine folded portion flattening apparatus.
Figure 14:
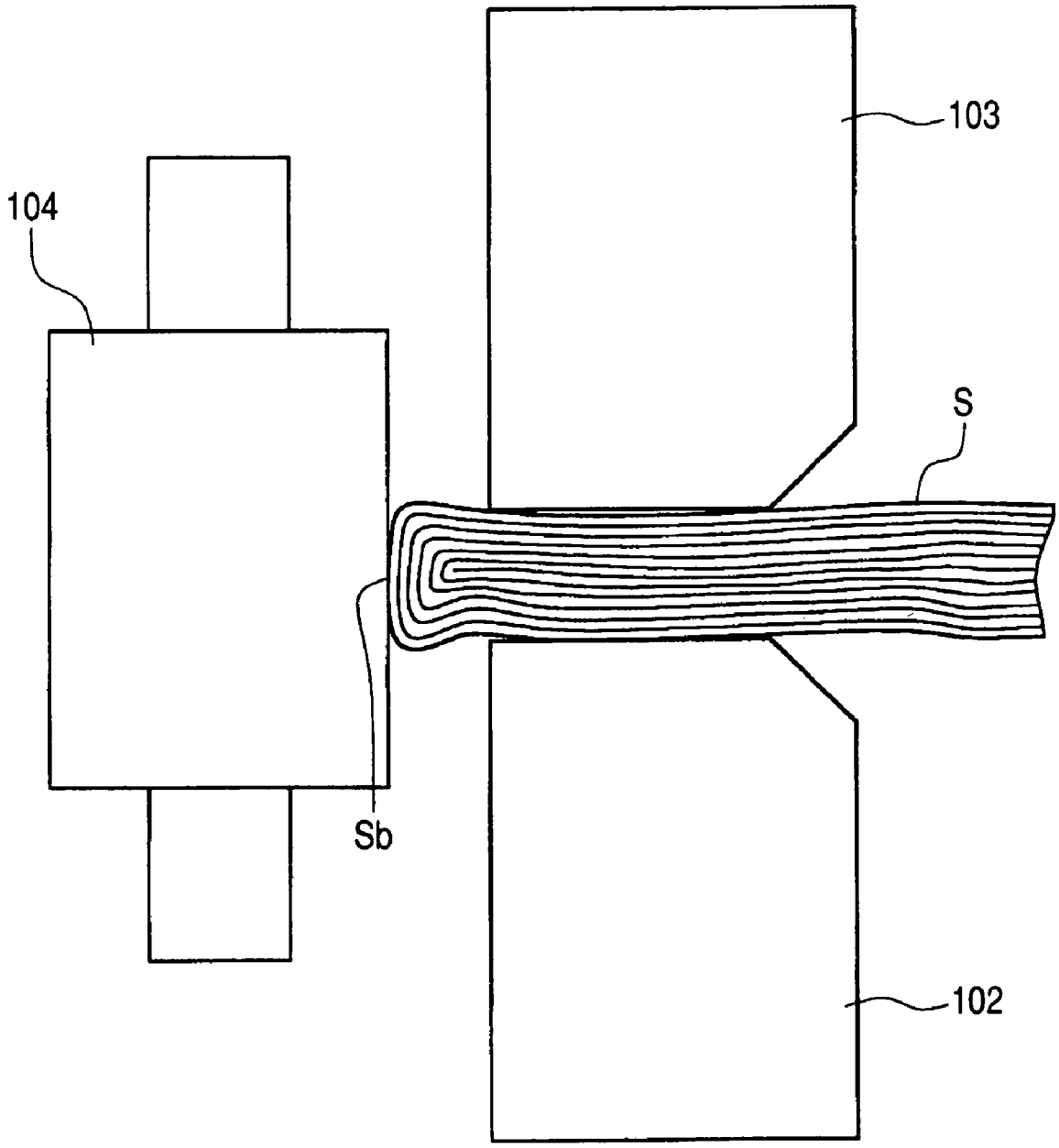
FIG. 14 is a schematic enlarged front view of the conventional spine folded portion flattening apparatus when it is flattening a spine folded portion.
Figure 15A:
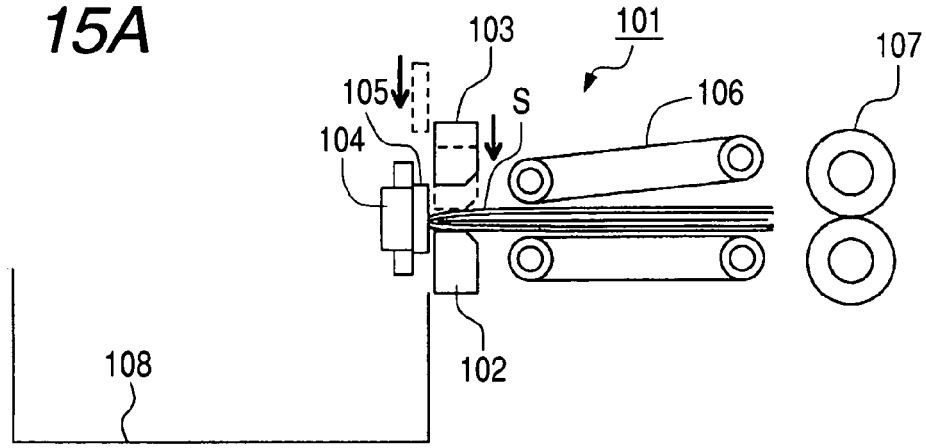
FIGS. 15A, 15B and 15C are front views for illustrating the operation of the conventional spine folded portion flattening apparatus.
Figure 15B:
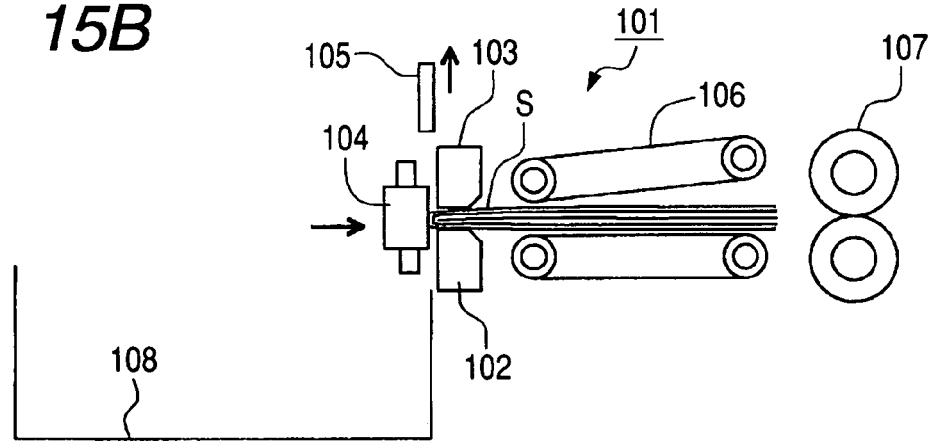
Figure 15C:
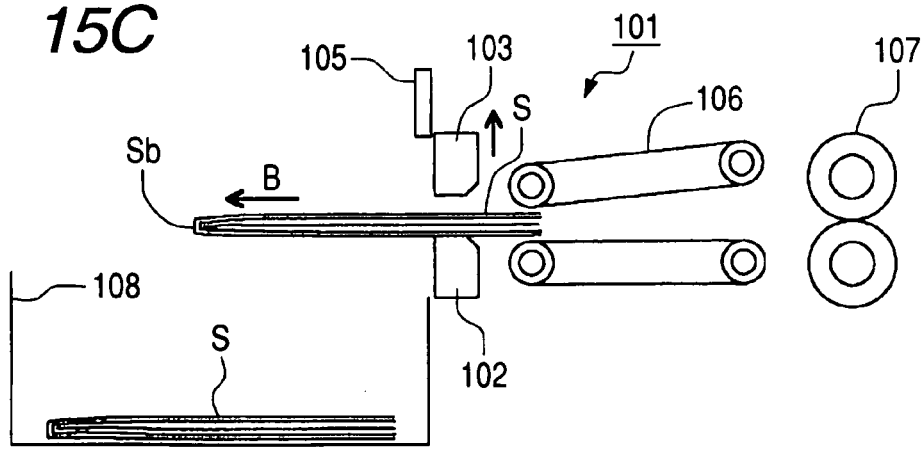
Figure 16:
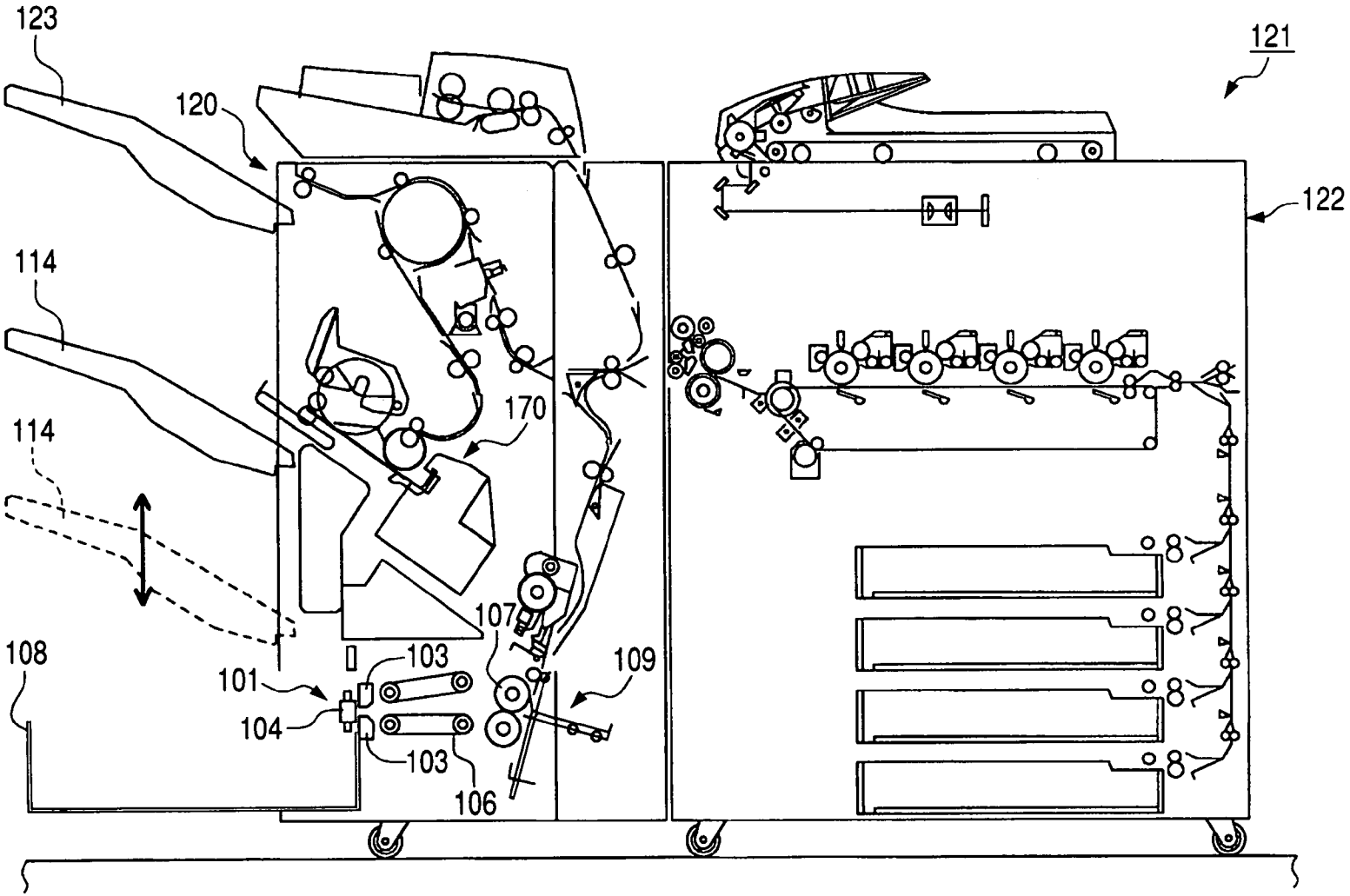
FIG. 16 is a schematic front cross-sectional view of an image forming apparatus provided with the conventional spine folded portion flattening apparatus.

Description of the Construction of the Spine Folded Portion Flattening Apparatus According to the Third Embodiment As shown in FIGS. 12A and 12B, the spine folded portion flattening apparatus 85 according to the third embodiment is also adapted to flatten the U-shaped curved spine folded portion (spine) Sb of a folio pamphlet-shaped sheet bundle sent thereto from the pamphlet making apparatus 79.

The spine folded portion flattening apparatus 85 according to the third embodiment differs in the construction of the gripping apparatus from the spine folded portion flattening apparatus 83 according to the first embodiment. That is, the gripping device 23 of the spine folded portion flattening apparatus 83 according to the first embodiment uses a pair of grippers 6 and 21, whereas the gripping device 91 of the spine folded portion flattening apparatus 85 according to the third embodiment uses a drive conveying roller 81 and a driven conveying roller 82 facing each other as a pair of rotary members. The differing portion will hereinafter be described, and the other portions need not be described.

The drive conveying roller 81 is adapted to be rotated by a driving motor (not shown). The driven conveying roller 82 is provided on a member like the shaping support arm 49 shown in FIG. 10, and is adapted to be moved up and down toward and away from the drive conveying roller 81. The drive conveying roller 81 and the driven conveying roller 82 are disposed along the direction indicated by the arrow C in which the sheet bundle is sent from the pamphlet making apparatus 79. A plurality of drive conveying rollers 81 and driven conveying rollers 82 may be provided.

Description of the Operation of the Spine Folded Portion Flattening Apparatus According to the Third Embodiment When a folded sheet bundle is not conveyed to the spine folded portion flattening apparatus 85, this apparatus 85 makes the driven conveying roller 82 wait at the position of broken line separate from the drive conveying roller 81. At this time, the interval between the driven conveying roller 82 and the drive conveying roller 81 is equal to or greater than the thickness of the sheet bundle.

As shown in FIG. 12A, the folded sheet bundle S conveyed from the direction indicated by the arrow C is stopped and positioned by the stopper plates 17. At this time, the stopper plates 17 are at the positions of solid lines in FIG. 12B. Thereafter, the driven conveying roller 82 is moved down and cooperates with the drive conveying roller 81 to nip the sheet bundle therebetween. Then, the stopper plates 17 are upwardly retracted from the positions of solid lines to the positions of broken lines. The stopper plates 17 need not always be retracted. They may remain having stopped the sheet bundle.

Then, the drive conveying roller 81 is rotated. The sheet bundle S is conveyed by the rotation of the drive conveying roller 81 and the driven conveying roller 82 is driven to rotate. The sheet bundle S is conveyed in the direction indicated by the arrow D and is discharged onto the sheet discharging tray portion 10. At this time, the sheet bundle S is conveyed in the direction indicated by the arrow D in such a manner as to push the shaping roller 7 aside by the spine folded portion Sb thereof. The construction for supporting the shaping roller 7 and biasing it toward the sheet bundle side is substantially the same as the pressing device 26 shown in FIG. 2 and therefore need not be described.

When the drive conveying roller 81 and the driven conveying roller 82 convey the sheet bundle to a discharging position indicated in FIG. 12B, the spine folded portion Sb of the sheet bundle S is formed flatly by the shaping roller 7, and the spine folded portion flattening process is completed. The present embodiment, unlike the gripping apparatuses in the first embodiment and the second embodiment, is not of a construction in which the whole of the spine folded portion of the sheet bundle S in the longitudinal direction thereof is nipped and therefore, it is desirable to install the shaping roller 7 as close as possible to the drive conveying roller 81 and the driven conveying roller 82 so that the spine folded portion Sb of the sheet bundle S may not escape due to the pressure force of the shaping roller 7. This is because the spine folded portion Sb of the sheet bundle S immediately after it has passed through the nip between the drive conveying roller 81 and the driven conveying roller 82 has high rigidity.

The drive conveying roller 81 and the driven conveying roller 82 together constitute a gripping device 91 as gripping means, a grip moving device 92 as grip moving means, and a moving device 93 as moving means.

As described above, the spine folded portion flattening apparatus 85 according to the present embodiment is adapted to press the spine folded portion Sb of the sheet bundle S by the shaping roller 7 to thereby flatten the U-shaped curved spine folded portion (spine cover) of the folio pamphlet-shaped sheet bundle while nipping the cover and spine cover of the spine folded portion Sb of the sheet bundle S by and between the pair of rollers 81 and 82 and conveying the sheet bundle, and discharge the sheet bundle to the sheet discharging tray portion 10. Therefore, the spine folded portion flattening apparatus 85 according to the present embodiment can effect the conveyance of the sheet bundle and the spine folded portion flattening process at a time, and can improve the sheet treating efficiency as compared with the conventional spine folded portion flattening apparatus which stops the sheet bundle and effects the spine folded portion flattening process. Also, it becomes unnecessary to widen the conveying interval between sheet bundles and therefore, the sheet bundle conveying efficiency can also be enhanced.

Further, the moving device 25 of the spine folded portion flattening apparatus according to the first embodiment requires a moving space in the direction indicated by the arrow D, whereas the pair of rollers 81 and 82 of the spine folded portion flattening apparatus 85 according to the third embodiment are adapted to be rotated to thereby convey the sheet bundle and therefore, do not require the moving space. According to the spine folded portion flattening apparatus 85 according to the third embodiment can also make the operation space smaller than the spine folded portion flattening apparatus 83 according to the first embodiment. Along therewith, the installation space for the sheet treating apparatus in the spine folded portion flattening apparatus 85 according to the present embodiment can be made small.

Also, the pair of rollers 81 and 82 are simple in construction and therefore, the spine folded portion flattening apparatus 85 according to the third embodiment can be made more compact than the spine folded portion flattening apparatus 84 according to the second embodiment.

While in the spine folded portion flattening apparatus according to each of the above-described embodiments, the shaping roller 7 is used as the rotary member for flattening the spine folded portion of the sheet bundle, it may be replaced by a circulated belt.

Also, while the spine folded portion flattening apparatus according to each of the above-described embodiments is adapted to flatten the spine folded portion of the sheet bundle saddle-stitched by the stapler 62, a sheet bundle not saddle-stitched, and a perfect binding sheet bundle can also have their spine folded portions likewise flattened.

This application claims priority from Japanese Patent Application No. 2004-019058 filed Jan. 27, 2004, and Japanese Patent Application No. 2005-009027 filed Jan. 17, 2005 which are hereby incorporated by reference herein.

What is claimed is:

1. A spine folded portion flattening apparatus which flattens a spine folded portion of a folded sheet bundle, comprising:

a conveying portion which conveys the folded sheet bundle;

a stopper which stops a top of the spine folded portion of the sheet bundle conveyed by the conveying portion a moving device which moves the folded sheet bundle stopped by the stopper, in a direction parallel to the spine folded portion of the folded sheet bundle; and a pressing portion which compresses and deforms the top of the spine folded portion of the folded sheet bundle being moved by said moving device so as to flatten the spine folded portion, wherein said moving device has a gripping portion which grips the sheet bundle, and a grip moving portion which moves said gripping portion in the direction parallel to the spine folded portion of the folded sheet bundle.

2. A spine folded portion flattening apparatus according to claim 1, wherein said gripping portion has a length equal to or greater than a length of the spine folded portion of the sheet bundle in a longitudinal direction thereof, and grips the sheet bundle with the spine folded portion protruded by a predetermined amount.

3. A spine folded portion flattening apparatus according to claim 1, wherein said pressing portion has a rotary member which presses the spine folded portion of the sheet bundle.

4. A spine folded portion flattening apparatus which flattens a spine folded portion of a folded sheet bundle, comprising:

a conveying portion which conveys the folded sheet bundle;

a stopper which stops a top of the spine folded portion of the sheet bundle conveyed by the conveying portion a moving device which moves the folded sheet bundle stopped by the stopper, in a direction parallel to the spine folded portion of the folded sheet bundle; and a pressing portion which compresses and deforms the top of the spine folded portion of the folded sheet bundle being moved by said moving device so as to flatten the spine folded portion, wherein said moving device has a pair of rotary members rotated with the sheet bundle nipped therebetween to thereby move the sheet bundle in the direction parallel to the spine folded portion of the sheet bundle.

5. A spine folded portion flattening apparatus according to claim 4, wherein said pressing portion has a rotary member which presses the spine folded portion of the sheet bundle.

6. A sheet treating apparatus which performs treatment on a sheet, comprising:

a folding device which folds the sheet;

a conveying portion which conveys a sheet bundle folded by the folding device;

a stopper which stops a top of the spine folded portion of the sheet bundle conveyed by the conveying portion;

a moving device which moves the folded sheet bundle stopped by the stopper, in a direction parallel to the spine folded portion of the sheet bundle; and a pressing portion which compresses and deforms the top of the spine folded portion of the sheet bundle being moved by said moving device so as to flatten the spine folded portion.

7. A sheet treating apparatus according to claim 6, wherein said moving device has a gripping portion which grips the sheet bundle, and a grip moving portion which moves said gripping portion in the direction parallel to the spine folded portion.

8. A sheet treating apparatus according to claim 7, wherein said gripping portion has a length equal to or greater than a length of the spine folded portion of the sheet bundle in a longitudinal direction thereof, and grips the sheet bundle with the spine folded portion protruded by a predetermined amount.

9. A sheet treating apparatus according to claim 6, wherein said moving device has a pair of rotary members rotated with the sheet bundle nipped therebetween to thereby move the sheet bundle in the direction along the spine folded portion.

10. A sheet treating apparatus according to claim 6, wherein said pressing portion has a rotary member which presses the spine folded portion of said sheet bundle.

11. A sheet treating apparatus according to claim 6, further comprising a stapler which binds the sheet bundle at a position corresponding to a folding position for the sheet bundle.

12. A sheet treating apparatus according to claim 6, further comprising a sheet discharging tray which stacks thereon the sheet bundle with a compressed and deformed spine folded portion, wherein said sheet discharging tray is provided on a side orthogonal to a side of the sheet treating apparatus on which a stacking portion for sheets not subjected to a flattening process is disposed.

13. An image forming apparatus comprising:

an image forming portion which forms an image on a sheet; and a sheet treating apparatus which performs treatment on the sheet on which the image has been formed by said image forming portion, said sheet treating apparatus including:

a folding device which folds the sheets;

a conveying portion which conveys a sheet bundle folded by the folding device;

a stopper which stops a top of the spine folded portion of the sheet bundle conveyed by the conveying portion;

a moving device which moves the folded sheet bundle stopped by the stopper, in a direction parallel to the spine folded portion of the folded sheet bundle; and a pressing portion which compresses and deforms the top of the spine folded portion of the sheet bundle being moved by said moving device so as to flatten the spine folded portion.

14. An image forming apparatus according to claim 13, wherein said moving device has a gripping portion which grips said sheet bundle, and a grip moving portion which moves said gripping portion in the direction along the spine folded portion.

15. An image forming apparatus according to claim 14, wherein said gripping portion has a length equal to or greater than a length of the spine folded portion of the sheet bundle in a longitudinal direction thereof, and grips the sheet bundle with the spine folded portion protruded by a predetermined amount.

16. An image forming apparatus according to claim 13, wherein said moving device has a pair of rotary members rotated with the sheet bundle nipped therebetween to thereby move said sheet bundle in the direction parallel to the spine folded portion.

17. An image forming apparatus according to claim 13, wherein said pressing portion has a rotary member which presses the spine folded portion of the sheet bundle.

18. An image forming apparatus according to claim 13, further comprising a sheet discharging tray which stacks thereon the sheet bundle with a compressed and deformed spine folded portion thereof flattened by the spine folded portion flattening apparatus, wherein said sheet discharging tray is provided on a side orthogonal to a side of the sheet treating apparatus on which a stacking portion for sheets not subjected to a flattening process is disposed.

* * * * *